US008083160B2

(12) United States Patent
Kato et al.

(10) Patent No.: US 8,083,160 B2
(45) Date of Patent: Dec. 27, 2011

(54) INJECTOR

(75) Inventors: Noritsugu Kato, Okazaki (JP); Hitoshi Shibata, Okazaki (JP); Toyoji Nishiwaki, Anjo (JP)

(73) Assignee: Denso Corporation, Kariya (JP)

( * ) Notice: Subject to any disclaimer, the term of this patent is extended or adjusted under 35 U.S.C. 154(b) by 417 days.

(21) Appl. No.: 12/412,513

(22) Filed: Mar. 27, 2009

(65) Prior Publication Data

US 2009/0242670 A1 Oct. 1, 2009

(30) Foreign Application Priority Data

Mar. 27, 2008 (JP) ..... 2008-84523
Jan. 21, 2009 (JP) ..... 2009-11319

(51) Int. Cl.
*F02M 61/00* (2006.01)

(52) U.S. Cl. ..... 239/533.12; 239/585.5

(58) Field of Classification Search ..... 239/533.12, 239/585.1, 585.4, 585.5
See application file for complete search history.

(56) References Cited

U.S. PATENT DOCUMENTS 5,931,391 A 8/1999 Tani et al.
6,070,812 A 6/2000 Tani et al.

FOREIGN PATENT DOCUMENTS

JP 63-191267 12/1988
JP 3-264767 11/1991
JP 08-028408 1/1996
JP 2000-314359 11/2000
JP 2004-204806 7/2004
JP 2006-207419 8/2006
JP 2007-085333 4/2007
JP 2007-162535 6/2007
JP 2008-151000 7/2008

OTHER PUBLICATIONS

Chinese Office Action dated Sep. 14, 2010, issued in corresponding Chinese Application No. 200910130160.7, with English translation.
Japanese Office Action dated Mar. 2, 2010, issued in corresponding Japanese Application No. 2009-011319, with English translation.

*Primary Examiner* — Christopher Kim
(74) *Attorney, Agent, or Firm* — Nixon & Vanderhye PC

(57) ABSTRACT

A fuel chamber defined by a recess portion of a valve body and a tip section of a valve member of an injector is structured such that a seat diameter Ds of a seat section of the valve member seated on a valve seat section formed on an inner peripheral surface of the valve body, an axial distance A between an inlet portion of an injection hole formed in the recess portion and the tip section of the valve member facing the inlet portion in the fuel chamber and an axial distance B between an inside region of the recess portion located radially inside the inlet portion of the injection hole in the fuel chamber and the tip section facing the inside region satisfy inequalities: $0.048 \leqq A/Ds \leqq 0.18$ and $B/Ds \leqq 0.18$.

21 Claims, 17 Drawing Sheets

INJECTOR

CROSS REFERENCE TO RELATED APPLICATION

This application is based on and incorporates herein by reference Japanese Patent Applications No. 2008-84523 filed on Mar. 27, 2008 and No. 2009-11319 filed on Jan. 21, 2009.

BACKGROUND OF THE INVENTION

1. Field of the Invention

The present invention relates to an injector that injects fuel.

2. Description of Related Art

A conventional injector has a valve member and a valve body that supports the valve member such that the valve member can move inside the valve body in an axial direction. An inner wall surface of the valve body and an outer wall surface of the valve member define a fuel passage therebetween. The valve body is formed with a valve seat section on the inner wall surface and with a recess portion downstream of the valve seat section. Injection holes are formed in the recess portion. The valve member has a seat section. The seat section is seated on the valve seat section to stop fuel injection from the injection holes. The seat section separates from the valve seat section to allow the fuel injection from the injection holes (for example, as described in Patent Document 1: JP-A-2000-314359). In this kind of injector, an end face of the seat section of the valve member is located to face the recess portion of the valve body, thereby defining a fuel chamber (which is referred to also as a sack section) between the recess portion and the end face of the seat section.

The device described in Patent Document 1 as a kind of such the injector has a single injection hole in the shape of a slit, i.e., an injection hole in the shape of a flat fan. The injector forms a fuel spray, which is injected from the injection hole, in the shape of a liquid membrane spreading flatly in a lateral direction in the shape of a fan. This technology uses a high penetration force (i.e., heightened injection velocity of the fuel) to form the liquid membrane of the fuel spray in the shape of the flat fan, thereby increasing a contact area between the liquid membrane and a surrounding air. Eventually, atomization of the fuel is enabled by friction between the liquid membrane and the surrounding air.

A device described in Patent Document 2 (JP-A-H11-70347) as another type of the injector is formed with multiple injection holes on the tip side of the valve body, i.e., in the recess portion. This technology improves the degree of freedom of formation of the fuel spray shape by injecting the fuel from the multiple injection holes. For example, the technology forms the fuel spray in the shape of the flat fan as described above or in a conical shape.

With the conventional technologies of Patent Documents 1 and 2, it is expected that the atomization of the fuel can be attained while diffusing the fuel spray in a cylinder when the fuel is injected directly into a combustion chamber of a cylinder (hereinafter, referred to simply as a cylinder inside) of an internal combustion engine. If the high atomization is aimed at, it is necessary to further increase the injection velocity from the injection hole, i.e. the penetration force. In this case, there is a concern that the injected fuel (i.e., the fuel spray) adheres to wall surfaces inside the cylinder such as a cylinder wall surface. The inventors consider that it is because a tip of the spray maintains an internal energy without splitting and therefore the velocity at the spray tip is less apt to fall in the conventional technologies of Patent documents 1 and 2.

If the injected fuel adheres to the cylinder wall surface the fuel turns into an unburned gas such as HC and can cause increase of smoke during a start from the cold state or the fuel adhering to the cylinder wall surface dilutes oil providing lubrication between a piston and the cylinder wall surface.

SUMMARY OF THE INVENTION

It is an object of the present invention to provide an injector capable of achieving both of a low penetration force and high atomization.

The inventors obtained following knowledge as the result of earnest study. That is, by forming a large velocity gradient, or more specifically by forming a large velocity gradient of fuel flow velocity at an outlet portion of an injection hole, splitting of injected fuel can be promoted and eventually atomization can be promoted without increasing a penetration force of the injected fuel. Hereafter, the gradient of the fuel flow velocity at the outlet portion of the injection hole is referred to simply as the velocity gradient, and average flow velocity of the fuel at the outlet portion of the injection hole is referred to as injection velocity.

If the above-described velocity gradient is formed, eventually, a disorder is caused in the fuel flowing through the inside of the injection hole. Therefore, there is a concern that the injection velocity falls compared with the case where the conventional technology is applied. In other words, the inventors consider that it is necessary to effectively increase the velocity gradient and to inhibit the reduction of the injection velocity accompanying the formation of the velocity gradient.

The present invention employs following technical means to attain the above-described object.

According to an aspect of the present invention (first invention), an injector has a valve body and a valve member. The valve body has an inner peripheral surface, which defines a fuel passage and which has a diameter reducing downstream with respect to a fuel flow direction. The valve body further has a valve seat section formed on the inner peripheral surface, a recess portion provided downstream of the valve seat section with respect to the fuel flow direction and an injection hole formed in the recess portion. The valve member is arranged in the valve body such that the valve member can reciprocate in an axial direction and has an outer peripheral surface defining the fuel passage with the inner peripheral surface of the valve body. The valve member has a seat section formed on the outer peripheral surface such that the seat section can be seated on the valve seat section and can separate from the valve seat section and a tip section arranged downstream of the seat section with respect to the fuel flow direction to face the recess portion. The injector injects the fuel, which flows into a fuel chamber defined by the recess portion and the tip section, through the injection hole when the seat section separates from the valve seat section.

The valve body is structured such that a virtual extended line extending from an inner peripheral surface portion of the inner peripheral surface, which provides the valve seat section, in a diameter reducing direction of the inner peripheral surface portion, along which a diameter of the inner peripheral surface portion reduces, exists at an inlet portion of the injection hole and intersects with an injection hole inner peripheral surface of the injection hole on a virtual plane including the central axis of the injection hole.

The tip section of the valve member has an inclined surface spreading inward in an annular shape from a downstream end of the seat section. The inclined surface spreads radially inward further than a position where the central axis of the injection hole intersects with the tip section.

In the above construction, when the fuel is injected from the injection hole, the fuel flows out to the fuel chamber because the seat section separates from the valve seat section. A mainstream direction of the fuel flowing out to the fuel chamber is decided mostly by the diameter reducing direction of the inner peripheral surface portion defining the valve seat section.

According to the above construction, the valve seat section of the valve body is structured such that the virtual extended line extending in the diameter reducing direction of the inner peripheral surface portion exists at the inlet portion of the injection hole and intersects with the injection hole inner peripheral surface. Therefore, the mainstream direction of the fuel can be controlled to the direction of the flow flowing straight into the inlet portion of the injection hole. In other words, by suppressing the turning loss of the fuel flow even after the mainstream of the fuel passes the valve seat section, the fuel can be caused to flow into the injection hole while inhibiting the reduction of the flow energy of the fuel.

Moreover, the tip section of the valve member has the inclined surface spreading inward in the annular shape from the downstream end of the seat section such that the inclined surface spreads radially inward further than a position where the central axis of the injection hole intersects with the tip section. Accordingly, even after the mainstream of the fuel passes the seat section, the fuel can be caused to flow into the injection hole while inhibiting the reduction of the flow energy of the fuel.

The mainstream of the fuel defined by such the construction of the valve seat section and the tip section can inhibit the reduction of the flow energy of the fuel and can cause the fuel to flow into the injection hole.

Moreover, the mainstream of the fuel collides with the injection hole inner peripheral surface when the mainstream of the fuel flows into the inlet portion of the injection hole. Therefore, a disorder can be caused in the fuel while the fuel moves from the inlet portion side to the outlet portion side along the injection hole inner peripheral surface, with which the mainstream of the fuel has collided. As a result, the large velocity gradient can be formed at the outlet portion of the injection hole.

With the construction according to the above aspect of the present invention, the atomization can be promoted by the combination of the formation of the velocity gradient at the outlet portion of the injection hole and the injection velocity unlike the conventional technology, which achieves the promotion of the atomization by the high penetration force, i.e., by increasing the injection velocity. Accordingly, the low penetration force and the high atomization can be achieved at the same time. Moreover, as measures against the decrease of the injection velocity due to the formation of the velocity gradient, the fuel is caused to flow into the injection hole while inhibiting the reduction of the flow energy. Accordingly, both of the low penetration force and the high atomization can be achieved at the same time while preventing the excessive fall of the injection velocity.

According to another aspect of the present invention, the inclined surface of the tip section spreads radially inward further than a position of the inlet portion of the injection hole.

With the above construction, even after the mainstream of the fuel passes the seat section, the turning loss of the fuel flow can be suppressed at least until the fuel flows to the position radially inside the inlet portion of the injection hole. Accordingly, the fuel can be caused to flow into the injection hole while maintaining the flow energy without decreasing the flow energy.

According to another aspect of the present invention, the inclined surface of the tip section is formed in the shape of a truncated cone.

With the above construction, excessive decrease of the axial gap between the recess portion and the tip section facing each other can be prevented. That is, a suitable axial gap can be secured between the tip section and the recess portion when the seat section is seated on the valve seat section.

According to another aspect of the present invention, the seat section has a seat surface arranged to face the inner peripheral surface portion of the valve seat section. The inclined surface is provided in the seat section to be inclined in a direction separating from the inner peripheral surface portion. An angle $\theta$ defined between the seat surface and the inclined surface satisfies an inequality: 18 degrees$\leqq\theta\leqq$27 degrees.

With the construction, the angle $\theta$ between the seat surface of the seat section, which is located to face the inner peripheral surface portion of the valve seat section, and the inclined surface, which is inclined in the direction separating from the inner peripheral surface portion, satisfies the inequality: 18 degrees$\leqq\theta\leqq$27 degrees. Thus, a fuel passage portion at the seat surface and the inclined surface in the fuel passage can be formed in a passage shape facilitating the inflow of the fuel to the injection hole. In other words, in the above-described fuel passage portion, a flow rate coefficient equal to or higher than a predetermined value can be secured.

According to another aspect of the present invention (second invention), an injector has a valve body and a valve member. The valve body has an inner peripheral surface, which defines a fuel passage and which has a diameter reducing downstream with respect to a fuel flow direction. The valve body further has a valve seat section formed on the inner peripheral surface, a recess portion provided downstream of the valve seat section with respect to the fuel flow direction and a plurality of injection holes formed in the recess portion. The valve member is arranged in the valve body such that the valve member can reciprocate in an axial direction and has an outer peripheral surface defining the fuel passage with the inner peripheral surface of the valve body. The valve member has a seat section formed on the outer peripheral surface such that the seat section can be seated on the valve seat section and can separate from the valve seat section and a tip section arranged downstream of the seat section with respect to the fuel flow direction to face the recess portion. The recess portion and the tip section provide a fuel chamber substantially in a cylindrical shape. The injector injects the fuel, which flows into the fuel chamber when the seat section separates from the valve seat section, through the injection holes.

A seat diameter Ds of the seat section seated on the valve seat section, an axial distance A between an inlet portion of the injection hole and the tip section facing the inlet portion in the fuel chamber and an axial distance B between an inside region of the recess portion located radially inside the inlet portion of the injection hole in the fuel chamber and the tip section facing the inside region satisfy inequalities: $0.048\leqq A/Ds\leqq 0.18$ and $B/Ds\leqq 0.18$.

With such the construction, when the fuel is injected from the injection hole, the fuel flows out to the fuel chamber because the seat section separates from the valve seat section. The mainstream direction of the flow of the fuel flowing out to the fuel chamber is decided mostly by the diameter reducing direction of the valve seat section in the inner peripheral surface having the diameter reducing toward the downstream side of the valve body with respect to the fuel flow direction. By causing the mainstream to collide with the injection hole inner peripheral surface of the injection hole when causing the mainstream to flow into the inlet portion of the injection hole, the flow direction of the mainstream is turned into the axial direction of the injection hole along the injection hole inner peripheral surface, against which the mainstream is pressed.

When the fuel flow including such the mainstream flows into the fuel chamber, there is a concern that the mainstream flow direction changes into a direction that provides the hydrodynamic minimum distance to the inlet portion of the injection hole depending on the size of the fuel chamber such as the facing distance between the tip section of the valve member and the recess portion in which the injection hole is formed. If the mainstream flow direction changes, there is a concern that the velocity gradient cannot be effectively increased at the outlet portion of the injection hole.

The inventors of the present invention obtained following knowledge as the result of earnest study about the injector having the above construction. That is, the velocity gradient can be increased effectively by the construction satisfying the inequality: $0.048 \leqq A/Ds \leqq 0.18$, wherein the value A/Ds is an index value related to the size of the axial distance A between the inlet portion of the injection hole and the tip section in the above-described fuel chamber. Thus, the injection velocity can be reduced to an extent that the adhesion of the injected fuel to the cylinder wall surface can be inhibited, i.e., the penetration force can be reduced. At the same time, the atomization can be further promoted with the velocity gradient that is increased effectively.

When $A/Ds > 0.18$ against the setting range: $0.048 \leqq A/Ds \leqq 0.18$, the mainstream flow direction heading to the inlet portion of the injection hole will change. In such the case, the degree of the interference between the injection hole inner peripheral surface and the mainstream changes and eventually the velocity gradient at the injection hole outlet portion becomes remarkably small. That is, the velocity gradient cannot be increased effectively.

The tests and the numerical analysis performed by the inventors focusing on a particle diameter of the fuel (referred to simply as a particle diameter, hereafter) revealed that, when $A/Ds < 0.048$ or $A/Ds > 0.18$, the particle diameter becomes remarkably large, i.e., the function to promote the atomization is impaired. In other words, the limit for allowing the decrease of the injection velocity is $A/Ds = 0.048$, and the limit for allowing the decrease of the velocity gradient is $A/Ds = 0.18$.

Moreover, the fuel chamber is structured such that an index value B/Ds related to the size of the axial distance B between the inside region existing radially inside the inlet portion of the injection hole and the tip section satisfies an inequality: $B/Ds \leqq 0.18$. Therefore, the velocity gradient can be increased effectively and preferentially. For example, the velocity gradient can be increased effectively and preferentially regardless of the injection velocity by fixing the value A/Ds to a predetermined amount and by reducing the value B/Ds.

Since the construction according to the above aspect of the present invention satisfies the inequalities: $0.048 \leqq A/Ds \leqq 0.18$ and $B/Ds \leqq 0.18$, the effectively increased velocity gradient can be formed. Accordingly, the atomization can be promoted, without increasing the penetration force as in the conventional technology. Therefore, the injector capable of achieving both of the low penetration force and the high atomization can be provided.

The injected fuel (i.e., the spray) having the velocity gradient increased in such the manner can promote the splitting of the fuel block in the initial stage of the injection process, thereby exhausting the internal energy of the spray. As a result, the injection velocity at the tip of the spray on the side near the cylinder wall surface can be reduced significantly.

According to another aspect of the present invention, the tip section of the valve member is formed in the shape of an inclined surface or a spherical surface spreading inward in an annular shape from a downstream end of the seat section, and the fuel chamber satisfies an inequality: $B < A$.

According to the above aspect of the present invention, the tip section of the valve member is formed in the shape of the inclined surface or the spherical surface spreading inward in the annular shape from the lower end of the seat section and satisfies the inequality: $B < A$. Therefore, when the fuel flow including the mainstream flows into the fuel chamber, the tip section can cause the other flows than the mainstream to flow along the inclined surface or the spherical surface spreading inward in the annular shape from the lower end of the seat section. Moreover, since the fuel chamber formed by the inclined surface or the spherical surface of the tip section is formed to satisfy the inequality: $B < A$, the flows other than the mainstream can be rectified toward the mainstream side. Thus, the other flows than the mainstream can be merged to the mainstream to strengthen the flow of the mainstream. Accordingly, the velocity gradient can be increased effectively and preferentially.

The present invention is not limited to the construction that the tip section defining the fuel chamber satisfies the inequality: $B < A$. Alternatively, for example, according to another aspect of the present invention, a stepped portion extending in the axial direction toward the tip section may be formed at the inside region of the recess portion, and the fuel chamber may be formed to satisfy the inequality: $B < A$.

As a method of effectively increasing the velocity gradient, according to another aspect of the present invention, the inlet portions of the injection holes are arranged along a single ring shape, and a pitch Dp between the inlet portions of the injection holes satisfies an inequality: $1.5 \leqq Ds/Dp \leqq 3$. According to another aspect of the present invention, the inlet portions of the injection holes are arranged on the same virtual circle, the center of which coincides with the central axis of the valve body, and a diameter Dp of the virtual circle satisfies an inequality: $1.5 \leqq Ds/Dp \leqq 3$.

The inventors of the present invention obtained following knowledge as the result of earnest study about the injector having the above-described constructions.

That is, in some cases, the mainstream flow direction heading to the inlet portion of the injection hole changes in accordance with the size of the distance (Ds−Dp) between the seat section and the injection hole in the fuel chamber, or the magnitude of the ratio (Ds/Dp) of the seat diameter Ds of the seat section to the diameter Dp of the above-described virtual circle or the pitch Dp. There is a concern that the mainstream in the flow direction changed in such the manner is pressed not against the injection hole inner peripheral surface on the inlet portion side but against the injection hole inner peripheral surface on the outlet portion side. That is, there is a possibility that the effectively increased velocity gradient is not formed at the outlet portion but only a disorder of the fuel flow is caused to an extent that the velocity difference is caused in the fuel velocity among different points at the outlet portion. There is a possibility that such the fuel spray injected from the outlet portion causes a disorder in the injection angle of the spray and a variation in the injection angle.

The inventors obtained the knowledge that, if the fuel chamber is structured such that the index value Ds/Dp concerning the size of the distance (Ds−Dp) between the seat section and the injection hole satisfies the inequality: $1.5 \leqq Ds/Dp \leqq 3$, the velocity gradient at the outlet portion of the injection hole can be increased effectively while suppressing the injection angle variation of the fuel spray injected from the outlet portion.

The injection angle indicates the inclination of the injection direction of the mainstream of the injected fuel (i.e., the fuel spray) injected from the outlet portion with respect to the central axis of the valve body.

When $Ds/Dp<1.5$ against the setting range: $1.5 \leqq Ds/Dp \leqq 3$, the radial distance between the seat section and the inlet portion of the injection hole is excessively short. In such the case, there is a concern that the mainstream heading to the inlet portion of such the injection hole is pressed not against the injection hole inner peripheral surface on the inlet portion side but against the injection hole inner peripheral surface on the outlet portion side. If the mainstream is pressed against the injection hole inner peripheral surface on the outlet portion side, the velocity gradient becomes remarkably small and eventually the velocity gradient cannot be increased effectively. As a result, a significant variation is caused in the injection angle of the spray.

As for the case where $Ds/Dp>3$, following knowledge was obtained as the result of the tests and the numerical analysis performed by the inventors. That is, when $Ds/Dp>3$, pressure in a pressure region [P1] equivalent to the inside region of the recess portion defining the fuel chamber becomes excessively higher than in the other portions. When such the pressure region occurs in the inside region, the mainstream heading to the inlet portion interferes with the pressure region. Eventually, there is a possibility that a disorder is caused in the fuel spray injected from the outlet portion and a significant variation is caused in the injection angle.

According to another aspect of the present invention, thickness t of a portion of the recess portion where the injection holes are formed and a diameter d of the injection hole satisfy an inequality: $1.25 \leqq t/d \leqq 3$.

In such the construction according to the above aspect of the present invention, when the mainstream flowing into the fuel chamber flows into the inlet portion of the injection hole, it is expected that the mainstream is pressed against the injection hole inner peripheral surface on the inlet portion side of the injection hole and the velocity gradient is effectively increased toward the outlet portion. However, after the mainstream is pressed against the injection hole inner peripheral surface, the other flows than the mainstream will also be rectified by the injection hole inner peripheral surface. Therefore, there is a possibility that the magnitude of the effectively increased velocity gradient significantly decreases depending on the size of the inner periphery length in the axial direction of the injection hole, i.e., the injection hole length.

In this regard, the inventors of the present invention obtained following knowledge as the result of earnest study about the injector having the above constructions. That is, if the index value t/d concerning the size of the injection hole length satisfies the inequality: $1.25 \leqq t/d \leqq 3$, the magnitude of the effectively increased velocity gradient will not fall significantly. The atomization is further promoted by such the effectively increased velocity gradient.

According to another aspect of the present invention, the axial direction of the injection hole is inclined such that an outlet portion of the injection hole is positioned farther from the central axis of the valve body than the inlet portion of the injection hole is.

With such the construction, when the mainstream flowing into the fuel chamber flows into the inlet portion of the injection hole, the mainstream can be effectively pressed against the injection hole inner peripheral surface portion on the side near the central axis of the valve body in the injection hole inner peripheral surface on the inlet portion side of the injection hole. Therefore, the velocity gradient effectively increased between the injection hole inner peripheral surface portion on the side near the central axis of the valve body and the inner peripheral surface portion on the side far from the central axis of the valve body can be formed at the outlet portion.

According to another aspect of the present invention, the inlet portion of the injection hole has a corner, at which an injection hole inner peripheral surface of the injection hole intersects with a recess inner peripheral surface portion of the inner peripheral surface formed in the recess portion, and a corner portion in the corner on a side near the valve seat section has a curved surface that smoothly connects the recess inner peripheral surface portion and the injection hole inner peripheral surface.

With such the construction, the inlet portion of the injection hole into which the mainstream flows can be structured such that a peripheral edge portion of the corner on the side into which the mainstream flows can be formed in the shape of a smooth spherical surface.

According to another aspect of the present invention, the fuel chamber is structured such that a seat diameter Ds of the seat section seated on the valve seat section, an axial distance A between the inlet portion of the injection hole and the tip section facing the inlet portion and an axial distance B between an inside region in the recess portion radially inside the inlet portion of the injection hole and the tip section facing the inside region satisfy inequalities: $0.048 \leqq A/Ds \leqq 0.18$ and $B/Ds \leqq 0.18$.

Thus, the fuel chamber is structured to satisfy the inequalities: $0.048 \leqq A/Ds \leqq 0.18$ and $B/Ds \leqq 0.18$. Accordingly, in the case where the fuel flows into the fuel chamber when the seat section separates from the valve seat section, the effectively increased velocity gradient can be formed to promote the atomization, without increasing the penetration force as in the conventional technology. Therefore, the low penetration force and the high atomization can be achieved at the same time more suitably.

The injected fuel (i.e., the spray) with the increased velocity gradient promotes the splitting of the fuel block in the initial stage of the injection process and exhausts the internal energy of the spray. Therefore, the injection velocity at the tip of the spray on the side near the cylinder wall surface can be reduced remarkably.

According to another aspect of the present invention, the fuel chamber satisfies an inequality: $B<A$.

According to the aspect, in addition to the premise construction that the inclined surface of the tip section of the valve member spreads at least inside the position where the central axis of the injection hole intersects with the tip section, the inclined surface of the tip section of the valve member is structured to satisfy the inequality: $B<A$. Accordingly, the other flows than the mainstream can be merged to the mainstream to strengthen the mainstream flow. Thus, the flow of the mainstream colliding with the injection hole inner peripheral surface on the inlet portion side can be strengthened, so the velocity gradient can be increased preferentially and effectively.

The present invention is not limited to the above construction that at least the inclined surface of the tip section is formed to satisfy the inequality: $B<A$. Alternatively, according to another aspect of the present invention, a stepped portion extending in an axial direction toward the tip section may be formed at the inside region of the recess portion, and the fuel chamber may satisfy the inequality: B<A.

As a method of effectively increasing the velocity gradient, in addition to the above constructions, according to another aspect of the present invention, the plurality of injection holes are formed in the recess portion such that the inlet portions of the injection holes are arranged along a single ring shape and a pitch Dp between the inlet portions of the injection holes satisfies an inequality: $1.5 \leqq Ds/Dp \leqq 3$. Alternatively, according to another aspect of the present invention, the plurality of injection holes are formed in the recess portion such that the inlet portions of the injection holes are arranged on the same virtual circle, the center of which coincides with the central axis of the valve body, and a diameter Dp of the virtual circle satisfies an inequality: $1.5 \leqq Ds/Dp \leqq 3$.

According to another aspect of the present invention, the index value t/d concerning the size of the injection hole length satisfies the inequality: $1.25 \leqq t/d \leqq 3$, thereby inhibiting the significant decrease of the magnitude of the effectively increased velocity gradient. Therefore, the atomization can be further promoted with such the velocity gradient that is increased effectively.

According to another aspect of the present invention, the central axis of the injection hole is inclined such that an outlet portion of the injection hole is farther from the central axis of the valve body than the inlet portion of the injection hole is.

According to the aspect, in addition to the premise construction that the valve body is structured such that the inlet portion is positioned on the virtual extended line extending in the diameter reducing direction of the inner peripheral surface portion of the valve seat section and the virtual extended line intersects with the injection hole inner peripheral surface, the injection hole inner peripheral surface provides the injection hole inner peripheral surface portion on the side near the body central axis. Accordingly, the velocity gradient at the outlet portion can be increased effectively.

According to another aspect of the present invention, the inlet portion of the injection hole has a corner, at which an injection hole inner peripheral surface of the injection hole intersects with a recess inner peripheral surface portion of the inner peripheral surface formed in the recess portion, and a corner portion in the corner on a side near the valve seat section has a curved surface that smoothly connects the recess inner peripheral surface portion and the injection hole inner peripheral surface.

According to the above aspect, even if at least the other flow than the mainstream passes the corner portion on the side near the valve seat section when the seat section separates from the valve seat section and the fuel flows into the inlet portion of the injection hole, the reduction of the flow energy can be suppressed.

According to yet another aspect of the present invention, a portion of the recess portion where the injection holes are formed has a flat surface as an end face on the injection hole inlet portion side and a spherical surface as the other end face on the injection hole outlet portion side.

The injection angle of the fuel spray is decided by the required performance of the engine mounted with the injector or the like. Therefore, there is a concern that the injection holes formed in the recess portion are set at the different injection angles. Since the injection hole length changes with the aimed injection angle, the degree of the atomization will differ between the injection holes having the different injection angles.

In contrast, with the above described construction, the injection hole inlet portion side is formed as the flat surface and the injection hole outlet portion side is formed as the spherical surface. Therefore, the change of the injection hole length due to the difference in the injection angles of the injection holes can be inhibited. Thus, the variation in the atomization among the injection holes having the different injection angles can be inhibited.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Hereafter, embodiments of the present invention will be described with reference to the drawings.

First Embodiment

Figure 2:
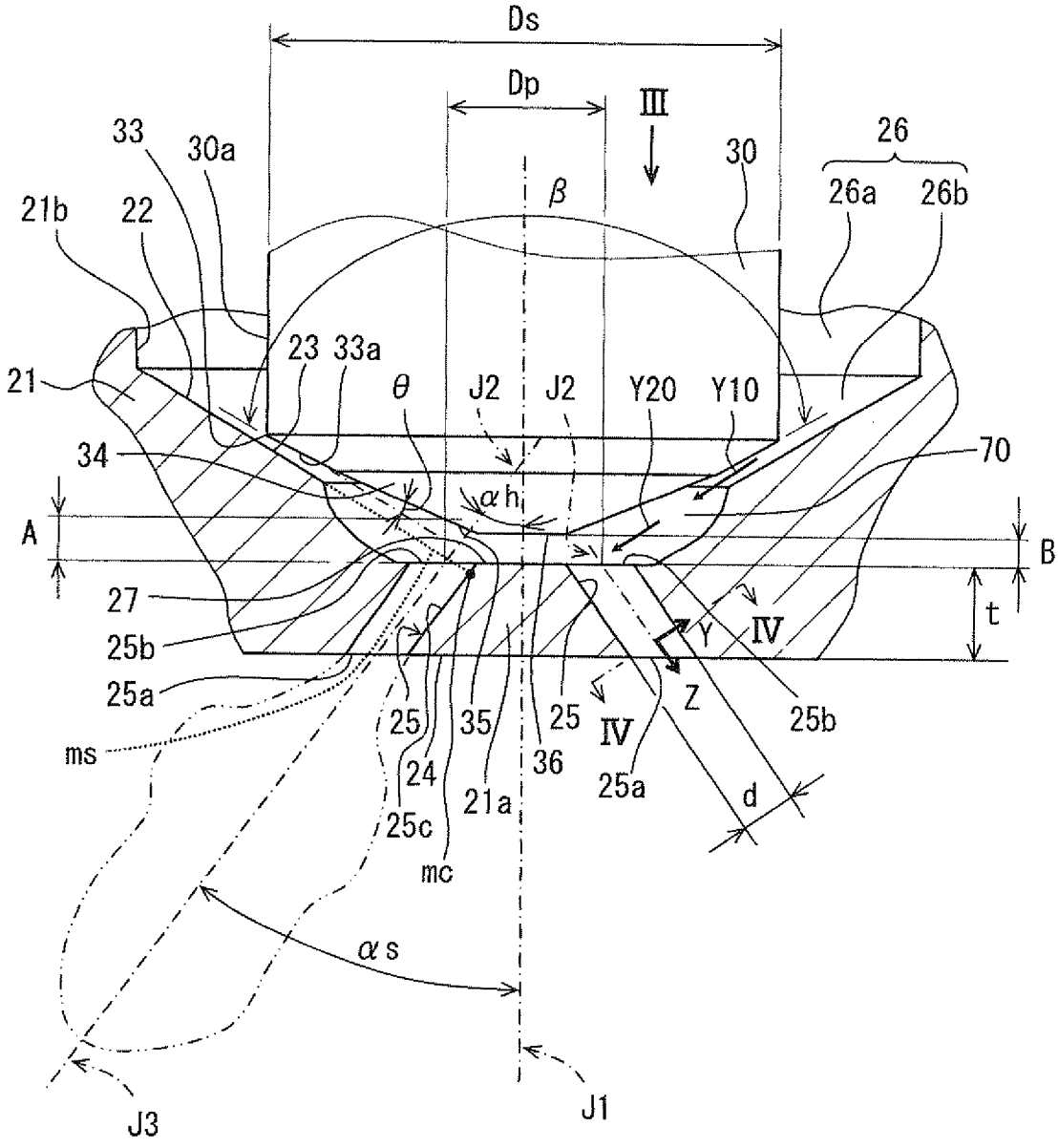
FIG. 2 is a sectional view showing a vicinity of injection holes and a fuel chamber of the injector according to the first embodiment.
Figure 3:
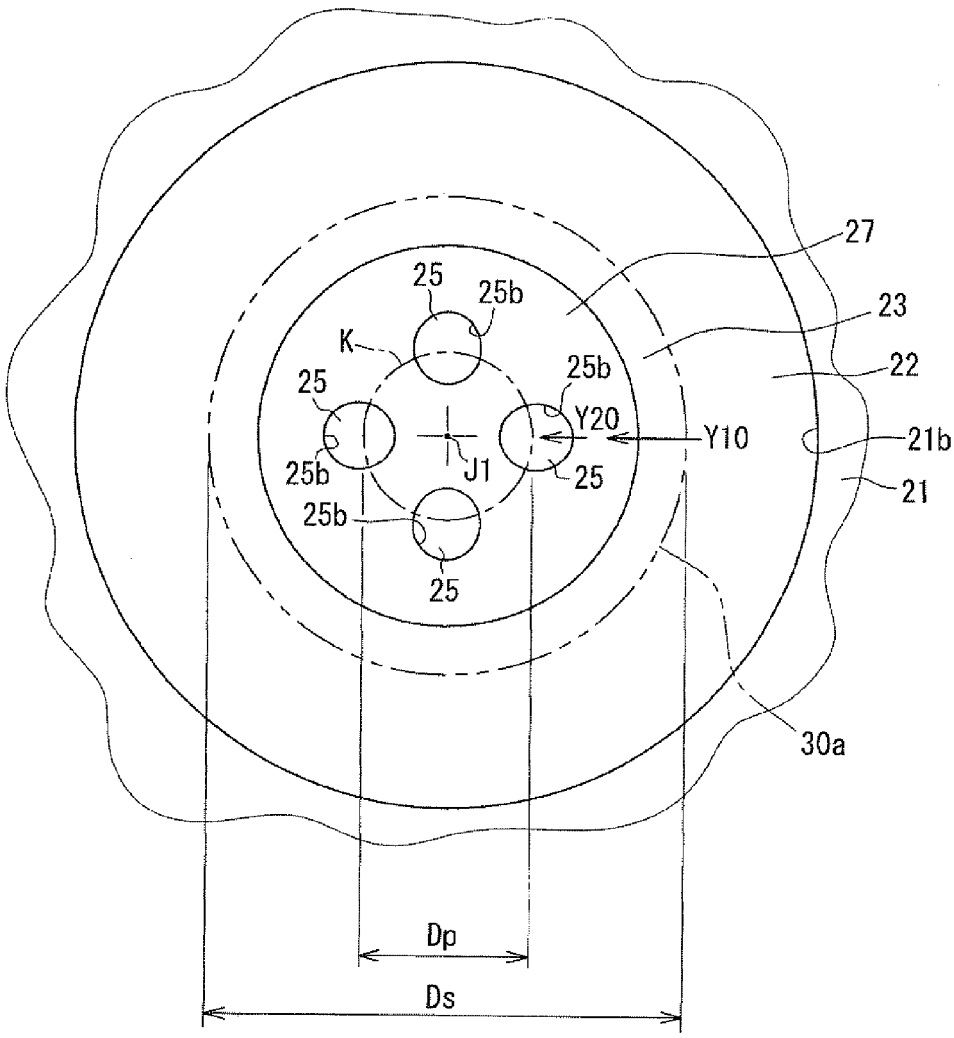
FIG. 3 is a plan view showing the fuel chamber of FIG. 2 along an arrow mark III.
Figure 6A:
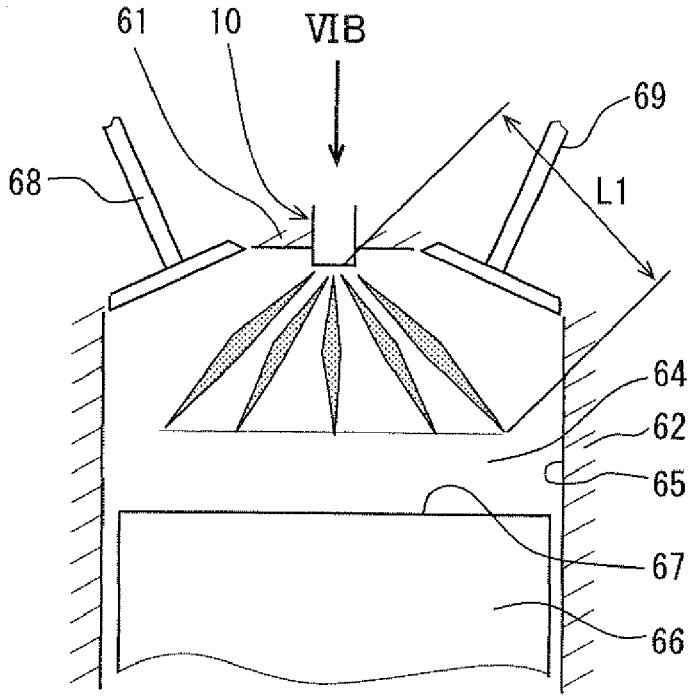
FIG. 6A is a sectional view showing a combustion chamber of an engine mounted with the injector according to the first embodiment.
Figure 6B:
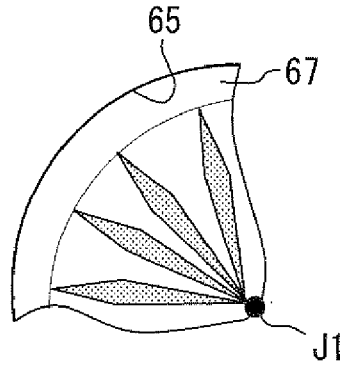
FIG. 6B is a diagram showing the combustion chamber of FIG. 6A along an arrow mark VIB.

Characteristic constructions according to the first embodiment include a construction related to the first invention and a construction related to the second invention. FIGS. 1 to 3, 6A and 6B show an injector 10 according to the present embodiment. FIGS. 2 and 3 show a characteristic portion of the injector 10 FIGS. 6A and 6B schematically show an entire configuration of a fuel injection device mounted with the injector 10 according to the present embodiment.

The injector 10 is fixed to a cylinder head 61 as shown in FIG. 6A. The fuel injection device according to the present embodiment is a device for a direct injection gasoline engine (referred to simply as an engine, hereafter) that injects fuel directly into a combustion chamber 64 formed by a wall surface of the cylinder head 61, an inner wall surface 65 of a cylinder block 62 (referred to as a cylinder wall surface, hereafter), and an upper end face 67 of a piston 66. The fuel, which is pressurized to pressure equivalent to fuel injection pressure with a fuel supply pump (not shown), is supplied to the injector 10. The fuel pressure is set at a predetermined pressure in the range from 1 MPa to 40 MPa. The injector 10 injects the fuel to the combustion chamber 64 at the fuel injection pressure in the range.

As shown in FIG. 6A as an example, the injector 10 is mounted between an intake valve 68 and an exhaust valve 69. That is, center mounting of the injector 10 in the cylinder head 61 is performed. An ignition device (not shown) is mounted to the cylinder head 61 at a position where the fuel injected from the injector 10 does not directly adhere to the ignition device and the ignition device can ignite a combustible air mixed with the fuel.

A fuel spray injected from the injector 10 is a spray in a conical shape. In order to prevent the spray from directly adhering to the cylinder wall surface 65 and the upper end face 67 of the piston 66, length from the injector 10 (in an example of FIG. 6B, from the central axis J1 of the injector 10) to a tip of the spray (hereinafter, referred to as spray length) is set at a predetermined spray length L1 such that a certain gap is provided between the tip of the spray and each of the cylinder wall surface 65 and the upper end face 67.

The above is the explanation of the entire configuration of the fuel injection device mainly constituted by the injector 10. Next, a basic structure of the injector 10 will be described.

(Basic Structure of Injector 10)

Figure 1:
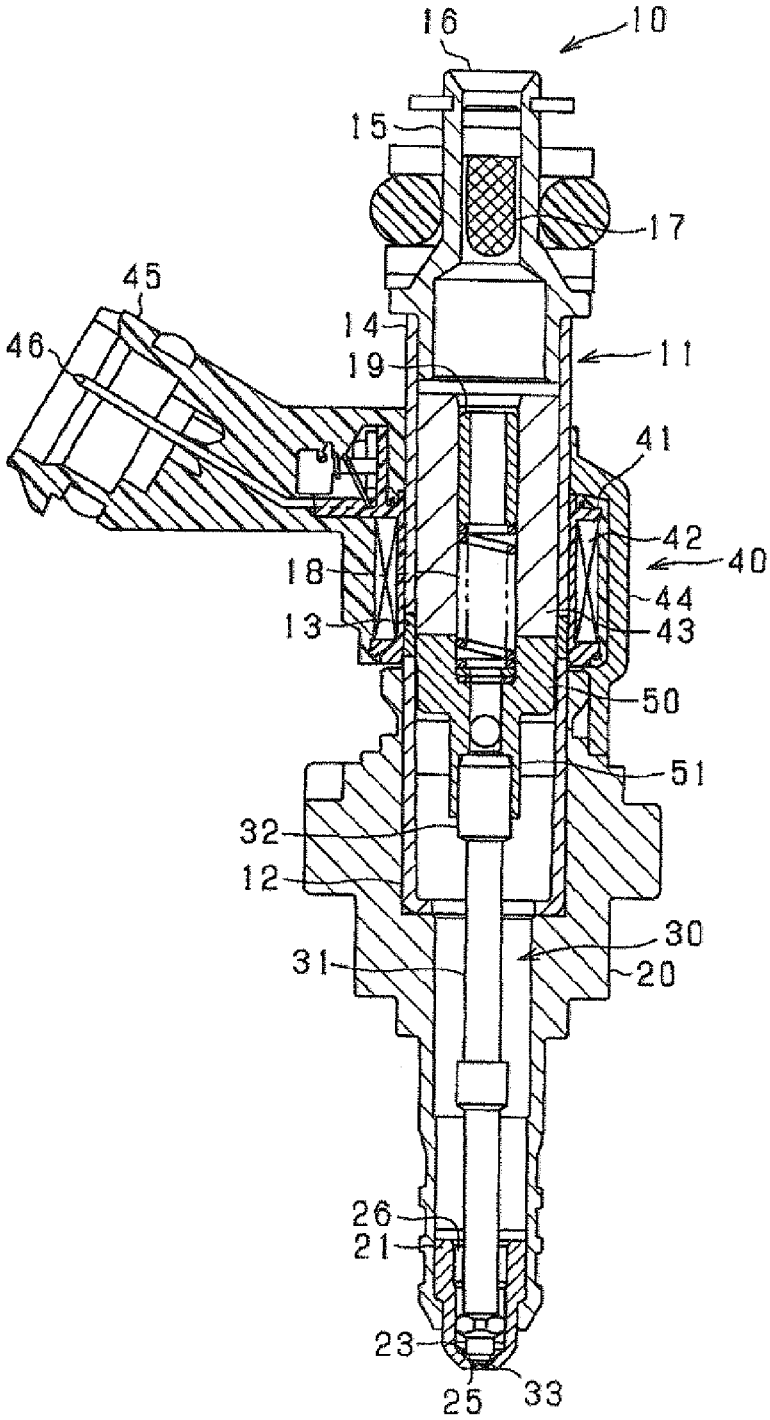
FIG. 1 is a sectional view showing an injector according to a first embodiment of the present invention.

As shown in FIG. 1, a housing 11 of the injector 10 is formed in a cylindrical shape. The housing 11 has a first magnetic section 12, a nonmagnetic section 13, and a second magnetic section 14. The nonmagnetic section 13 prevents a magnetic short circuit between the first magnetic section 12 and the second magnetic section 14. The first magnetic section 12, the nonmagnetic section 13 and the second magnetic section 14 are connected to each other into one body, for example, by laser welding or the like.

An inlet member 15 is provided on an axial end of the housing 11. The inlet member 15 is fixed to an inner peripheral side of the housing 11, for example, by press fit. The inlet member 15 has a fuel inlet 16. The fuel (in the present embodiment, gasoline fuel) is supplied to the fuel inlet 16 with the above-described fuel supply pump. The fuel supplied to the fuel inlet 16 flows into the inner peripheral side of the housing 11 via a fuel filter 17, which removes extraneous matters.

A nozzle holder 20 is provided on the other end of the housing 11. The nozzle holder 20 is formed in a cylindrical shape, and a nozzle body 21 as a valve body is provided in the nozzle holder 20. The nozzle body 21 is formed in the shape of a cylinder having a bottom and is fixed to the nozzle holder 20, for example, by press fit or welding. An inner peripheral surface 21*b* of the nozzle body 21 in the shape of the cylinder having the bottom defines a conical inner wall surface 22, an inner diameter of which reduces toward its tip as shown in FIG. 2. A valve seat section 23 is formed on the inner wall surface 22. A recess portion 27 is formed at the lower end of the valve seat section 23.

Multiple (four, in the present embodiment) injection holes 25 are formed near the end of the nozzle body 21 on an opposite side from the housing 11, i.e., in the recess portion 27. The injection holes 25 penetrate through the nozzle body 21 and open in the inner wall surface 22 and an outer wall surface 24. The fuel supplied to the fuel inlet 16 is injected into the combustion chamber 64 of a cylinder of the engine (i.e., to a cylinder inside) from the injection holes 25.

FIG. 3 is a plan view showing a single body of the nozzle body 21 of FIG. 2 along a direction of an arrow mark III. As shown in FIG. 3 as an example, inlet portions 25*b* of the multiple injection holes 25 are arranged on a single virtual circle K (hereinafter, referred to also as a pitch circle). That is, the multiple injection hole inlet portions 25*b* are arranged along a single annular shape on the virtual circle K. The center of the virtual circle K coincides with the central axis of the injector 10. The center of the virtual circle K substantially coincides with the central axis J1 of the housing 11, the nozzle holder 20 and the nozzle body 21. The central axis J1 is referred to simply as the central axis J1 of the nozzle body 21, hereafter.

Pitches between the inlet portions 25*b* of the adjacent injection holes 25 are set on the virtual circle K as the substantially equal pitches.

An axial tip section of the nozzle body 21, i.e., the recess portion 27, has a bottom portion that is formed in the shape of a plate and that spreads perpendicularly to the central axis J1 as shown in FIG. 2. The injection holes 25 are formed in a plate-like portion 21*a* of the bottom portion having the uniform width t. A section of the injection hole 25 perpendicular to the central axis J2 of the injection hole 25, i.e., a cross-section of the injection hole 25, is formed in the round shape. A direction of penetration of the injection hole 25, i.e., the central axis J2, is inclined such that an outlet portion 25*a* of the injection hole 25 is located radially outside the inlet portion 25*b* of the injection hole 25 from the central axis J1. As shown in FIG. 2, the bottom portion of the recess portion 27 and the valve seat section 23 are smoothly connected with each other via a curved surface.

On the inner peripheral surface 21*b* of the nozzle body 21, the recess portion 27 recessed toward the injection holes 25 is formed between the conical inner wall surface 22 and the inlet portions 25*b* of the injection holes 25. Thus, a fuel chamber 70 of the recess portion 27 invariably communicates with the inlet portions 25*b* of the multiple injection holes 25, thereby facilitating distribution of the fuel in the recess portion 27 to the multiple injection holes 25.

The housing 11, the nozzle holder 20 and the nozzle body 21 constitute the valve body, which forms an accommodation chamber inside. A needle 30 as a valve member is accommodated in the accommodation chamber. The needle 30 is accommodated radially inside the housing 1 the nozzle holder 20 and the nozzle body 21 such that the needle 30 can reciprocate in the axial direction.

The needle 30 is provided substantially coaxially with the nozzle body 21. The needle 30 has a shaft section 31, a head section 32, a seat section 33, and a tip section 34 as shown in FIGS. 1 and 2. The head section 32 is located at an axial end of the shaft section 31 on the fuel inlet 16 side. The seat section 33 is located on an end of the shaft section 31 on the injection hole 25 side. As shown in FIG. 2, the seat section 33 can be seated on and can separate from the valve seat section 23 of the nozzle body 21.

The tip section 34 has end faces 35, 36 in the shape of a truncated cone extending from the lower end of the seat section 33 inward in an annular shape. The end faces 35, 36 consist of a first end face 35 (referred to as an inclined surface, hereinafter) and a second end face 36 (referred to as an opposed end face, hereinafter). The inclined surface 35 is formed in the shape of a cone formed along an angle different from a diameter reducing angle of the seat section 33. The diameter reducing angle of the seat section 33 is an angle, at which the diameter of the seat section 33 reduces toward the tip. The opposed end face 36 is substantially parallel to the bottom portion of the recess portion 27.

A fuel passage 26, through which the fuel flows, is formed between an outer peripheral surface 30*a* of the needle 30 and the inner peripheral surface 21*b* of the nozzle body 21. The fuel passage 26 is provided to be able to communicate with the injection holes 25. The fuel passage 26 is structured such that the flow of the fuel toward the injection holes 25 is blocked when the seat section 33 is seated on the valve seat section 23 and such that the flow of the fuel toward the injection holes 25 is allowed when the seat section 33 separates from the valve seat section 23.

The injector 10 has a drive section 40 for driving the needle 30 as shown in FIG. 1. The drive section 40 has a spool 41, a coil 42, a fixed core 43, a plate housing 44, and a movable core 50. The spool 41 is provided around the outer periphery of the housing 11. The spool 41 is formed of a resin material in a cylindrical shape, and the coil 42 is wound around the outer periphery of the spool 41. Both ends of the wound coil 42 are electrically connected with terminals 46 of a connector 45. The fixed core 43 is provided radially inside the coil 42 across the housing 11. The fixed core 43 is formed of a magnetic material such as the iron in a cylindrical shape and is fixed to the inner peripheral side of the housing 11, for example, by press fit. The plate housing 44 is formed of a magnetic material and covers the outer peripheral side of the coil 42.

The movable core 50 is located coaxially with the fixed core 43 to face the fixed core 43 such that the movable core 50 can reciprocate in the axial direction radially inside the housing 11. The movable core 50 is formed of a magnetic material such as the iron in the shape of a cylinder. The movable core 50 has a cylinder section 51 on a side opposite from the fixed core 43. The head section 32 of the needle 30 is press fit in the cylinder section 51. Thus, the needle 30 and the movable core 50 are connected with each other into a single body, for example, by welding or the like, such that the needle 30 and the movable core 50 can move together.

A spring 18 as a biasing member made of a resilient material is provided on an end of the movable core 50 on the fixed core 43 side. The spring 18 exerts a force (a biasing force) to extend in the axial direction. The spring 18 is arranged so that both ends of the spring 18 are held between the movable core 50 and an adjusting pipe 19. The spring 18 pushes the movable core 50 and the needle 30 in a direction for seating the needle 30 on the valve seat section 23. The adjusting pipe 19 is structured to be fixed to the fixed core 43, for example, by press fit or the like. The biasing force (i.e., load) of the spring 18 is adjusted by adjusting the press fit amount of the adjusting pipe 19 press fit in the fixed core 43.

When the coil 42 is not energized, the movable core 50 and the needle 30 integrated with the movable core 50 are pushed toward the valve seat section 23 side, and the seat section 33 is seated on the valve seat section 23. Thus, the fuel injection from the injection holes 25 is blocked. If the coil 42 is energized, the movable core 50 is attracted by the fixed core 43 and the needle 30 separates from the valve seat section 23. Thus, the fuel is injected from the injection holes 25.

Hereafter, the state where the needle 30 is separate from the valve seat section 23 will be referred to as a lifting state of the needle 30. A lift amount of the needle 30 is decided by an air gap between magnetic pole faces of the movable core 50 and the fixed core 43.

The above is the explanation of the basic structure of the injector 10 according to the present embodiment. Next, characteristic constructions of the injector 10 according to the present embodiment will be explained. The characteristic constructions include the construction related to the first invention and the construction related to the second invention. First, the construction related to the second invention will be explained below.

(Characteristic Construction of Injector 10 Related to Second Invention)

The inventors of the present invention invented the characteristic construction for achieving both of a low penetration force and high atomization based on following findings as the result of earnest study. The low penetration force prevents the fuel of the fuel spray of the injector 10 from adhering to the wall surfaces 65, 67 of the cylinder inside 64.

(Principle for Solving Problem)

Figure 5A:
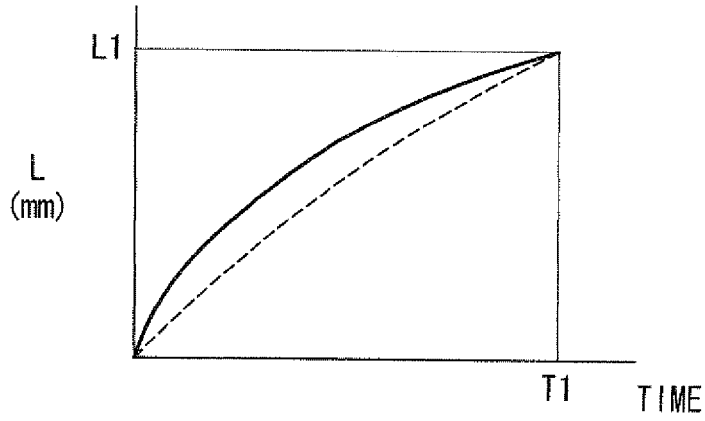
FIG. 5A is a diagram showing a chronological feature of length of a fuel spray injected from an outlet portion of the injection hole of the injector according to the first embodiment.
Figure 5B:
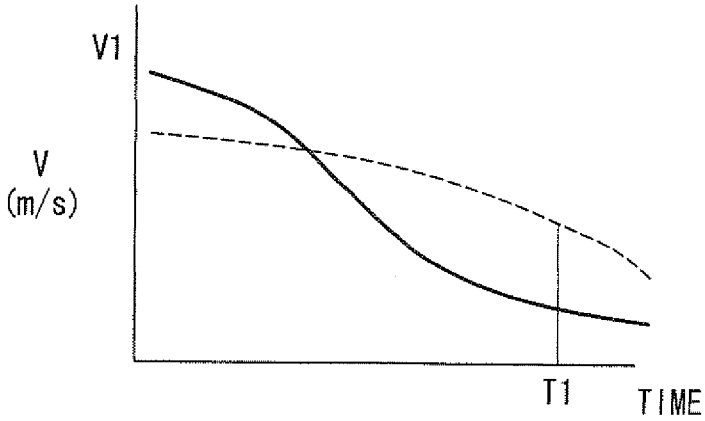
FIG. 5B is a diagram showing a chronological feature of injection velocity of the fuel spray injected from the outlet portion of the injection hole of the injector according to the first embodiment.

FIG. 5A shows change of the spray length L (referred to also as penetration), which grows in time series, of the fuel spray injected from the injector 10 in a chronological order. FIG. 5B shows change of injection velocity V at the tip of the spray in a chronological order. The spray length L1 in FIG. 5A is spray length at an injection end time (at time T1 in FIG. 5A). The spray length L1 is set to provide a certain gap from each of the wall surfaces 65, 67 of the cylinder inside 64 (refer to FIG. 6A). In FIGS. 5A and 5B, chronological characteristics indicated by solid lines (referred to as injected fuel characteristics of the present invention, hereafter) exemplify the embodiment of the present invention. Chronological characteristics indicated by broken lines (referred to as injected fuel characteristics of a conventional technology, hereafter) exemplify a comparison example applied with a conventional technology.

The inventors consider the injected fuel characteristics of the conventional technology as follows. That is, when the conventional technology is applied, the velocity of the tip of the spray injected from the injection hole 25 does not reduce drastically but reduces only gradually in general in a growing process of the spray length. In an injection period of the injector 10, the tip of the spray having grown to the spray length L1 at the injection end time (i.e., at the time T1 of FIG. 5A) has substantially the same force for going through the cylinder inside (referred to as the penetration force, hereinafter) as the penetration force in an initial stage of the injection, in which the fuel is injected from the outlet portion 25*a* of the injection hole 25. Accordingly, an internal energy is preserved in the injected fuel at the tip section thereof. While an outside fuel portion of the fuel injected from the injection hole 25 is atomized by shear with an ambient air in the spray growing process, an inside fuel portion of the injected fuel preserves the internal energy until the inside fuel portion is atomized by the shear with the ambient air after the atomization of the outside fuel portion.

If the high atomization is aimed at in such the fuel injection device (referred to simply as a device, hereafter) applied with the conventional technology, the penetration force has to be heightened because a flying distance of the injected fuel (i.e., the spray length L1) shortens with the atomization. As a result, the injection velocity at the tip of the spray length L1 is increased by the high penetration force. Therefore, for example, if the spray interferes with an airflow or the like generated in the cylinder inside 64, there is a possibility that the fuel at the tip of the spray length L1 maintaining the high penetration force collides with and adheres to the wall surfaces 65, 67 of the cylinder inside 64.

Next, setting of the injected fuel characteristics according to the present invention, which the inventors consider suitable, will be explained below. If a large gradient of the fuel flow velocity V (referred to simply as a velocity gradient VG, hereafter) is formed at the outlet portion 25*a* of the injection hole 25, separation between a high velocity fuel portion and a low velocity fuel portion of a block of the injected fuel (hereafter, referred to as a fuel block) is facilitated and splitting of the fuel block can be promoted. In the injected fuel having such the effectively increased velocity gradient VG, the atomization due to the shear with the ambient air is promoted for each one of the split block portions of the fuel block. Accordingly, the atomization is promoted without increasing the penetration force as in the conventional technology.

Moreover, even if the injection velocity V is increased (to the injection velocity V1 shown in FIG. 5B) in the initial stage of the injection as compared to the device applied with the conventional technology as shown in FIG. 5B, the internal energy exerting the penetration force in the injection process falls significantly since the splitting of the fuel block is promoted. As a result, the velocity V of the tip of the spray length L1 at the injection end time can be reduced significantly.

Figure 4:
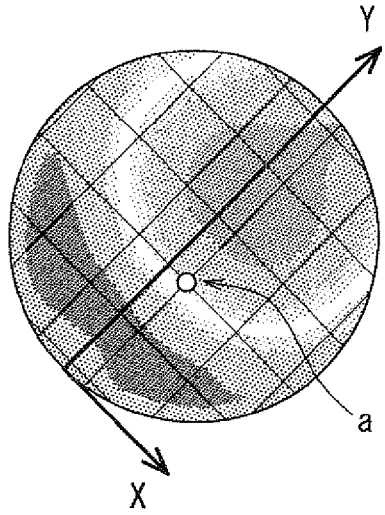
FIG. 4 is a diagram showing a velocity gradient of a fuel flow at an outlet portion of the injection hole of FIG. 2 along an arrow mark IV.

Next, the definition of the above-described velocity gradient VG will be explained with reference to FIG. 4. FIG. 4 is a diagram explaining the definition of the velocity gradient VG, and the Y-axis and the Z-axis in FIG. 2 correspond to the Y-axis and the Z-axis in FIG. 4 respectively. The velocity gradient VG at an arbitrary point (indicated by a circle mark "a" in FIG. 4) in the outlet portion 25*a* of the injection hole 25 on the X-Y plane is expressed with a following expression (a). In the expression (a), s represents a scalar quantity of the flow velocity V.

$$VG = \left(\frac{ds}{dx}, \frac{ds}{dy}, \frac{ds}{dz}\right) \tag{a}$$

The velocity gradient VG on the entire X-Y plane in the outlet portion 25*a* of the injection hole 25 (i.e., velocity gradient average in the entirety of the outset section 25*a* of the injection hole 25) is defined by a following expression (b). In the expression (b), S represents the area of the outlet portion 25*a*.

$$VG = \frac{\sum_{0}^{s} \sqrt{\left(\frac{ds}{dx}\right)^2 + \left(\frac{ds}{dy}\right)^2 + \left(\frac{ds}{dz}\right)^2}}{S} \tag{b}$$

Hereafter, the simple description "velocity gradient VG" means the velocity gradient VG defined by the expression (b). The simple description "injection velocity V" means the average velocity of the fuel flow having the above-described velocity gradient VG at the outlet portion 25*a*.

(Characteristic Construction of Fuel Passage 26)

The fuel passage 26 is formed between the inner peripheral surface of the valve body 11, 20, 21 and the outer peripheral surface of the needle 30, and the fuel flows through the fuel passage 26. In the following explanation referring to FIGS. 2 and 3, the simple description "fuel passage 26" means the passage formed between the inner peripheral surface 21*b* of the nozzle body 21 and the outer peripheral surface 30*a* of the needle 30.

As shown in FIG. 2, in the fuel passages 26, a fuel passage portion that is formed between the inner peripheral surface 21*b* of the nozzle body 21 and the outer peripheral surface 30*a* of the needle 30 and that extends in the axial direction of the injector 10 is referred to as a first fuel passage 26*a*. A fuel passage portion that is formed between "the conical inner wall surface 22 and the recess portion 27" and "the seat section 33 and the tip section 34 of the needle 30" is referred to as a second fuel passage 26*b*.

The first fuel passage 26*a* is formed in an annular shape extending in the axial direction. The second fuel passage 26*b* is formed as a passage that spreads in an annular shape inward from the downstream end of the first fuel passage 26*a* and that communicates with the multiple injection holes 25.

The second fuel passage 26*b* has the fuel chamber 70 defined by the recess portion 27 and the tip section 34 downstream of the valve seat section 23 and the seat section 33, which allow and stop the flow of the fuel flowing through the fuel passage 26. When the seat section 33 is separate from the valve seat section 23, a mainstream direction of the flow of the fuel flowing out to the fuel chamber 70 (for example, an arrow mark direction Y10 of FIGS. 10A and 11A) is decided mostly by a diameter reducing direction of the valve seat section 23 in the inner wall surface 22 having the diameter reducing downstream with respect to the fuel flow direction. The diameter reducing direction of the valve seat section 23 is a direction, along which the diameter of the valve seat section 23 reduces.

Therefore, in order to effectively increase the velocity gradient VG at the outlet portion 25*a* of the injection hole 25 and increase the injection velocity V at the outlet portion 25*a* in an allowable range by controlling the mainstream direction of the flow of the fuel flowing into the fuel chamber 70, the nozzle body 21 and the needle 30 according to the present embodiment are structured to satisfy following conditions (1), (2), (3) and (4).

An axial distance between the inlet portion 25*b* of the injection hole 25 and the inclined surface 35 of the tip section 34 opposed to the inlet portion 25*b* during the lift of the needle 30 is referred to as "an injection hole inlet directly above gap A" hereafter. The seat diameter of the seat section 33 of the needle 30 is indicated by Ds. A ratio A/Ds of the injection hole inlet directly above gap A to the seat diameter Ds satisfies an inequality: $0.048 \leqq A/Ds \leqq 0.18$ (condition (1)). The ratio A/Ds indicates an index value (or a similar figure value) related to the size of the injection hole inlet directly above gap A in the fuel chamber 70.

An axial distance between an inside region of the plate-like portion 21*a* radially inside the injection hole inlet portion 25*b* and the opposed end face 36 of the tip section 34 opposed to the inside region is referred to as "an injection hole inside region directly above gap B" hereafter. A ratio B/Ds of the injection hole inside region directly above gap B to the seat diameter Ds satisfies an inequality: $B/Ds \leqq 0.18$ (condition (2)). The ratio B/Ds indicates an index value related to the size of the injection hole inside region directly above gap B in the fuel chamber 70.

A ratio Ds/Dp of the seat diameter Ds to the diameter Dp of the virtual circle K, on which the injection hole inlet portions 25*b* are located, satisfies an inequality: $1.5 \leqq Ds/Dp \leqq 3$ (condition (3)). The ratio Ds/Dp indicates an index value related to the size of the radial distance (Ds−Dp) between the seat section 33 and the injection hole 25.

A ratio t/d of the thickness t of the plate-like portion 21*a* as the bottom portion of the recess portion 27 to the diameter d of the injection hole 25 satisfies an inequality: $1.25 \leqq t/d \leqq 3$ (condition (4)). The ratio t/d indicates an index value related to the size of the inner peripheral length of the injection hole 25 in the central axis J2 direction thereof i.e., the injection hole length.

As for the gaps A and B corresponding to the conditions (1) and (2), an inequality: B<A should be preferably satisfied. The direction of the central axis J2 of the injection hole 25 should be preferably inclined such that the outlet portion 25*a* of the injection hole 25 is farther from the central axis J1 of the nozzle body 21 than the inlet portion 25*b* is.

The inlet portion 25*b* of the injection hole 25 is formed with a corner, at which an injection hole inner peripheral surface 25*c* of the injection hole 25 intersects with a recess inner peripheral surface portion of the recess portion 27 (i.e., an upper end face of the bottom portion of the recess portion 27) in the inner peripheral surface 21*b*. A corner portion of the corner on a side near the valve seat section 23 should preferably have a curved surface that smoothly connects the recess inner peripheral surface portion and the injection hole inner peripheral surface 25*c* of the injection hole 25. With such the construction, the inlet portion 25*b*, into which the mainstream of the fuel flows, can be structured such that a peripheral edge portion of the corner on the side, into which the mainstream flows, is formed in the shape of a smooth pin-shaped corner, for example.

(Reason and Effect of Setting of Range of Index Value A/Ds of Injection Hole Inlet Directly Above Gap A Related to Fuel Chamber 70)

Depending on the size of the injection hole inlet directly above gap A, there is a concern that the mainstream flow direction changes into a direction that provides the hydrodynamic minimum distance to the inlet portion 25*b* of the injection hole 25. If the flow direction of the mainstream changes, there is a concern that a pressing degree of pressing the mainstream against the injection hole inner peripheral surface 25*c* of the injection hole 25 changes. In such the case, there is a concern that the velocity gradient VG at the outlet portion 25*a* of the injection hole 25 is not increased effectively although a velocity difference is caused in the fuel velocity between different positions in the section perpendicular to the central axis J2 direction of the injection hole 25.

Figure 7A:
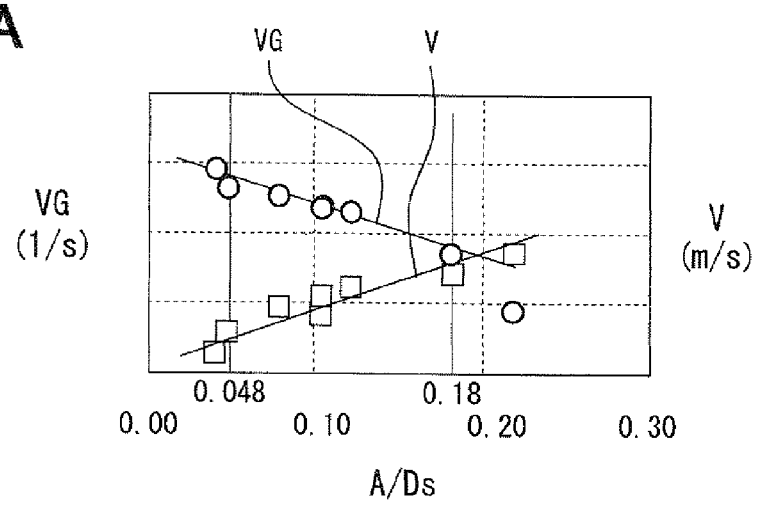
FIG. 7A is a characteristic diagram showing relationships among a value A/Ds, the velocity gradient and the injection velocity according to the first embodiment.
Figure 7B:
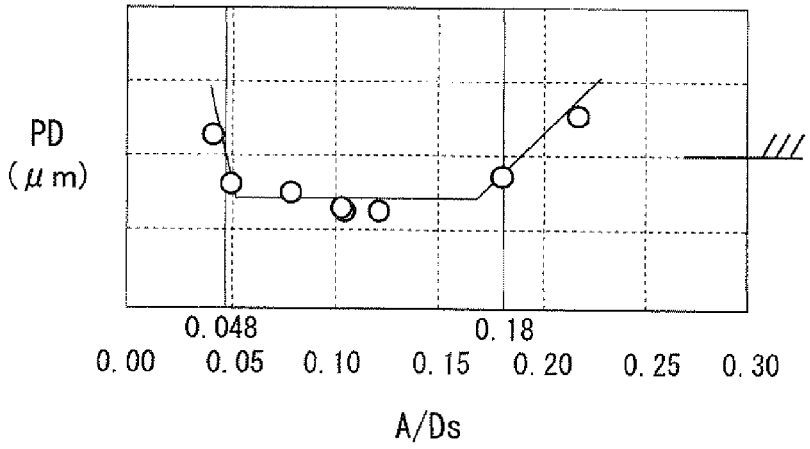
FIG. 7B is a characteristic diagram showing a relationship between the value A/Ds and a particle diameter according to the first embodiment.
Figure 7C:
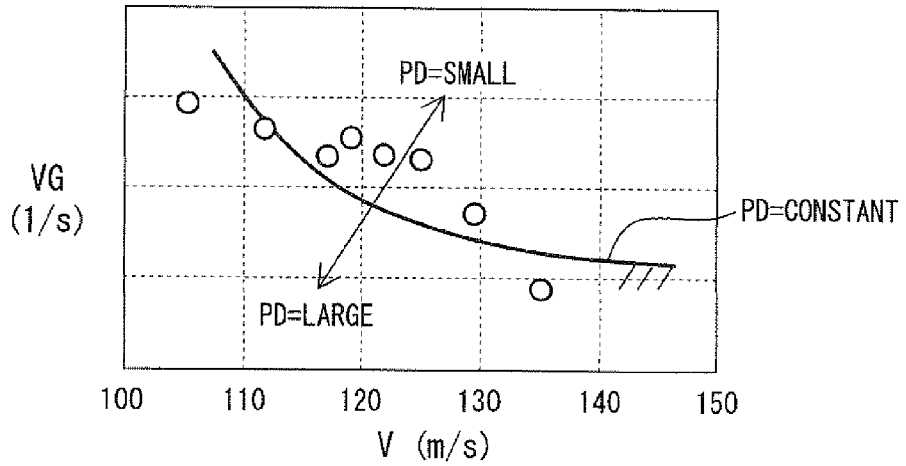
FIG. 7C is a characteristic diagram showing a relationship between the velocity gradient and the injection velocity according to the first embodiment.

The experiments and numerical analysis performed by the inventors revealed that following effects are exerted when the condition (1) ($0.048 \leqq A/Ds \leqq 0.18$) is satisfied. FIGS. 7A to 7C show test results of measuring the velocity gradient VG, the injection velocity V and a particle diameter PD of a single injector 10 while changing the value A/Ds as a parameter. The conditions of the experiments and the numerical analysis include a condition; fuel injection pressure=10 MPa. Solid lines in FIGS. 7A to 7C show the data obtained by the numerical analysis.

FIG. 7A shows relationships among the value A/Ds, the velocity gradient VG and the injection velocity V. The velocity gradient VG increases as the value A/Ds decreases. That is, the velocity gradient VG decreases as the value A/Ds increases. When the value A/Ds is increased to more than 0.18, the velocity gradient VG becomes significantly small. In this case, the flow direction of the mainstream toward the inlet portion 25*b* of the injection hole 25 changes into, e.g., a direction substantially perpendicular to the central axis J1 of the nozzle body 21 due to diffusion of the fuel. Thus, the pressing degree of pressing the mainstream against the inner peripheral surface of the injection hole 25 changes. As a result, the velocity gradient VG at the outlet portion 25*a* of the injection hole 25 becomes significantly small. That is, the velocity gradient VG cannot be increased effectively.

FIG. 7C shows the relationship between the velocity gradient VG and the injection velocity V with a curve line of the equal particle diameter, focusing on the particle diameter PD of the spray. As the particle diameter PD in FIGS. 7B and 7C, the Sauter's mean diameter (SMD) obtained from the actual particle diameter distribution of the spray is used. As shown in FIG. 7C, both of the injection velocity V and the velocity gradient VG contribute to the promotion of the atomization, but the possible magnitudes of the injection velocity V and the velocity gradient VG have a mutually exclusive relationship.

FIG. 7B shows the result of the test and the numerical analysis performed by the inventors, paying attention to such the particle diameter PD. It is found that when the value A/Ds is smaller than 0.048 or larger than 0.18, the particle diameter PD increases significantly, i.e., the function of promoting the atomization is impaired. In other words, it is found that the limit for effectively increasing the velocity gradient VG while allowing the decrease in the injection velocity V is A/Ds=0.048, and the limit capable of allowing the decrease in the velocity gradient VG while allowing the increase range of the injection velocity V, which has the mutually exclusive relationship with the velocity gradient VG, is A/Ds=0.18.

Thus, with the characteristic construction of the present embodiment satisfying the condition: $0.048 \leqq A/Ds \leqq 0.18$, the effectively increased velocity gradient VG can be formed. As a result, the atomization can be promoted without increasing the penetration force as in the conventional technology. Moreover, the splitting of the fuel block of the injected fuel (i.e., the spray) is promoted in the initial stage of the injection process with the initial velocity gradient in the initial stage of the injection. By promoting the splitting of the fuel block, the injection velocity at the tip of the spray on a side close to the cylinder wall surface 65 or the piston upper end face 67 of the cylinder inside 64 (i.e., the tip section injection velocity in the end of the injection) can be reduced significantly from the initial injection velocity in the initial stage of the injection.

In other words, the injection velocity V can be reduced to an extent that the adhesion of the injected fuel to the wall surfaces 65, 67 in the cylinder is suppressed (i.e., the penetration force can be reduced) and also the atomization can be further promoted with the effectively increased velocity gradient.

(Reason and Effect of Setting Range of Index Value B/Ds of Injection Hole Inside Region Directly Above Gap B)

When the fuel flow including the above-described mainstream flows into the fuel chamber 70, there is a possibility that the flow other than the mainstream is diffused along the outer peripheral surface 30*a* of the tip section 34 and the inner peripheral surface 21*b* of the recess portion 27 defining the fuel chamber 70 and is dissociated from the mainstream.

In view of such the circumstances, the characteristic construction satisfying the inequality: $B/Ds \leqq 0.18$ is employed in addition to the condition (1). The velocity gradient VG can be increased preferentially and effectively by satisfying the above-described characteristic constructions, i.e., the conditions (1) and (2).

Figure 8A:
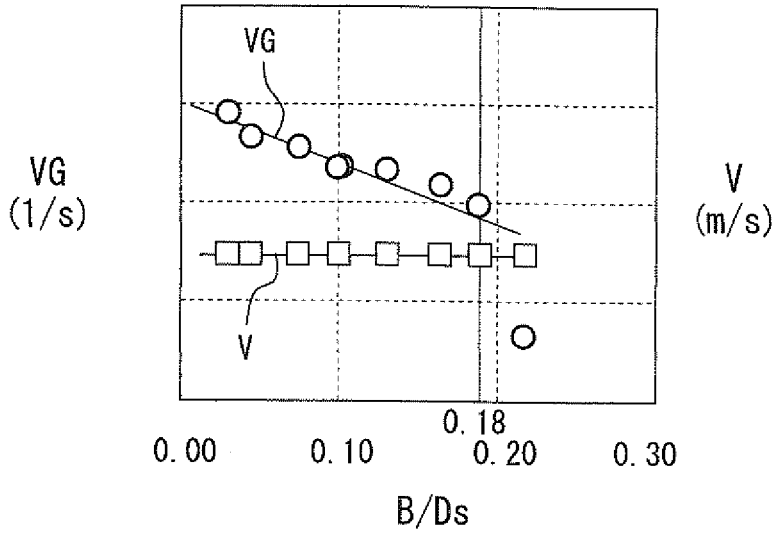
FIG. 8A is a characteristic diagram showing a relationship among a value B/Ds, the velocity gradient and the injection velocity according to the first embodiment.
Figure 8B:
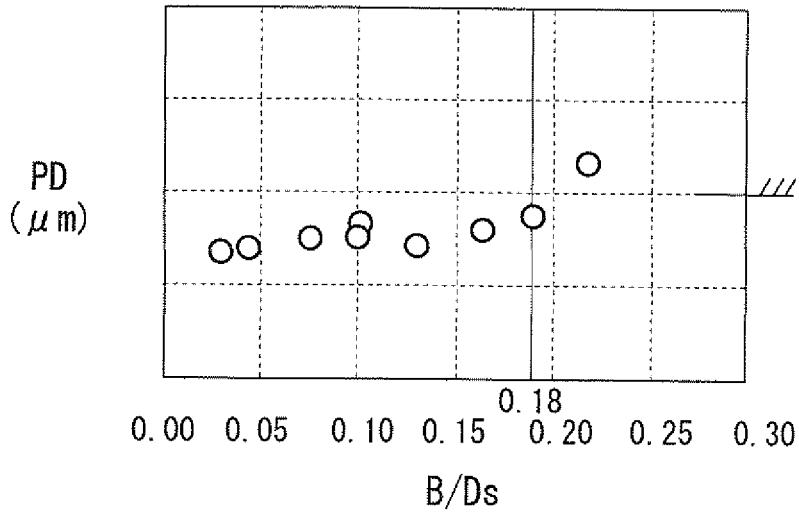
FIG. 8B is a characteristic diagram showing a relationship between the value B/Ds and the particle diameter according to the first embodiment.

FIGS. 8A and 8B show test results of measuring the velocity gradient VG, the injection velocity V and the particle diameter PD of a single injector 10 while changing the value B/Ds as a parameter. Conditions of the test and the numerical analysis include a condition: the fuel injection pressure=10 MPa, and A/Ds=0.18. Solid lines in FIG. 8A are data obtained by the numerical analysis.

FIG. 8A shows relationships among the value B/Ds, the velocity gradient VG and the injection velocity V. The velocity gradient VG decreases as the value B/Ds is increased. When the value B/Ds is increased to more than 0.18, the velocity gradient VG becomes significantly small. Since the value A/Ds is fixed at 0.18, the injection velocity V corresponding to the value A/Ds (=0.18) as shown in FIG. 7A is constant regardless of the value B/Ds. The velocity gradient VG in the case where A/Ds=0.18 shown in FIG. 7A can be further increased by decreasing the value B/Ds, i.e., by decreasing the value B as compared with the value A.

Since the velocity gradient VG can be increased effectively and preferentially in this way, the atomization of the fuel can be promoted more effectively as shown in FIG. 8B.

(Reason and Effect of Setting Range of Index Value Ds/Dp)

In addition to the method of effectively increasing the velocity gradient VG by the conditions (1) and (2), the inventors found a following method. That is, the effectively increased velocity gradient VG can be formed also by a method based on a characteristic construction focusing on the ratio Ds/Dp of the seat diameter Ds of the seat section 33 to the diameter Dp of the virtual circle (i.e., the pitch circle).

Figure 9A:
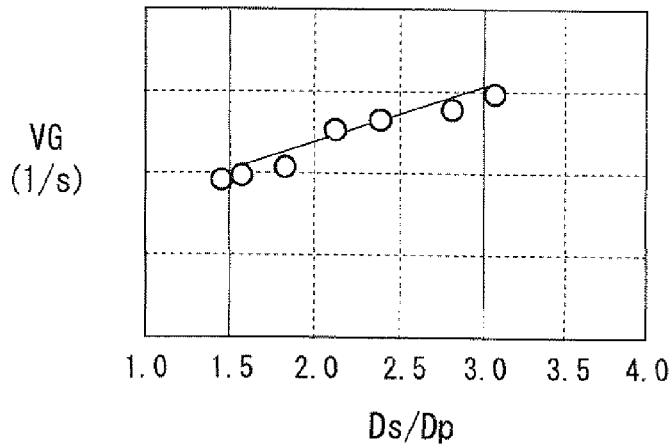
FIG. 9A is a characteristic diagram showing a relationship between a value Ds/Dp and the velocity gradient according to the first embodiment.
Figure 9B:
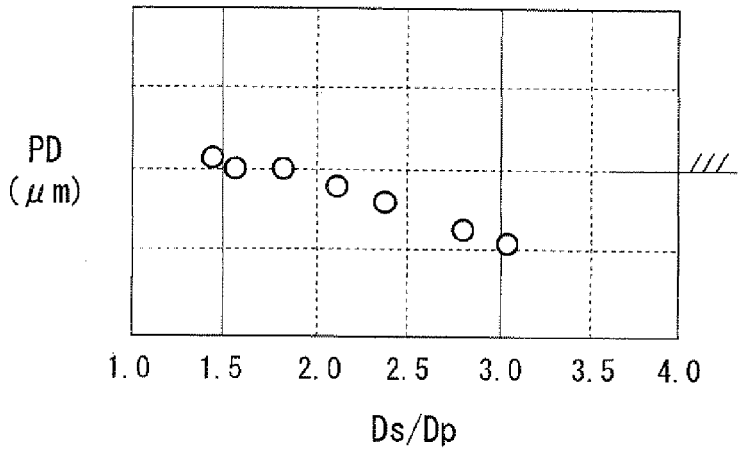
FIG. 9B is a characteristic diagram showing a relationship between the value Ds/Dp and the particle diameter according to the first embodiment.
Figure 9C:
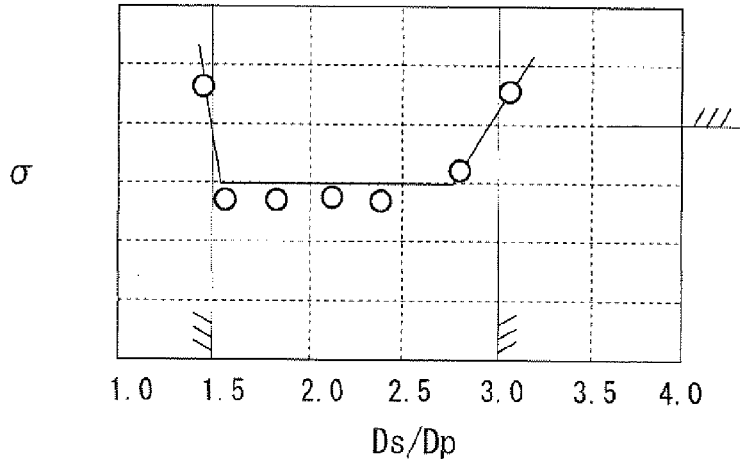
FIG. 9C is a characteristic diagram showing a relationship between an injection angle variation of the spray and the value Ds/Dp according to the first embodiment.

FIGS. 9A to 9C show test results of measuring the velocity gradient VG, the injection velocity V and the particle diameter PD about a single injector 10 while changing the value Ds/Dp as a parameter. Since the mutually exclusive relationship between the velocity gradient VG and the injection velocity V has been explained above, the description of the injection velocity V is omitted in the drawings. FIGS. 9B and 9C focus on the spray that is highly atomized by the velocity gradient VG. FIG. 9B shows the relationship between the value Ds/Dp and the particle diameter PD. FIG. 9C shows the relationship between a degree $\sigma$ of a variation in an injection angle as (or a spray angle) related to the spray shape and the value Ds/Dp. The injection angle as expresses the injection mainstream direction J3 of the injected fuel (spray) actually injected from the injection hole 25 as shown by a chain double-dashed line in FIG. 2 as an inclination from the central axis J1 of the nozzle body 21. The vertical axis of FIG. 9C indicates the degree $\sigma$ of the variation in the injection angle $\alpha s$ and is the standard deviation $\sigma$ that shows the degree of the variation in the injection angle $\alpha s$ with respect to an inclination ah of the injection hole 25 in FIG. 2, i.e., an inclination $\alpha h$ of the central axis J2.

The flow direction of the mainstream directed toward the injection hole inlet portion 25*b* changes in accordance with the magnitude of the value Ds/Dp. The inventors consider that there is a concern that the mainstream with the changed flow direction does not collide with and is not pressed against the injection hole inner peripheral surface portion on the inlet portion 25*b* side but collides with and is pressed against the injection hole inner peripheral surface portion on the outlet portion 25*a* side in the injection hole inner peripheral surface 25*c* of the injection hole 25. That is, there is a possibility that the velocity gradient VG at the outlet portion 25*a* is not formed as the effectively increased velocity gradient VG but only a disorder of the fuel flow is caused to an extent that the velocity difference exists in the fuel flow velocity among different points in the outlet portion 25*a*. The fuel spray in such the case can cause a disorder in the injection angle as of the spray and cause a variation in the injection angle $\alpha s$.

In view of such the circumstances, the characteristic construction satisfying the inequality: $1.5 \leqq Ds/Dp \leqq 3$ is employed. Thus, the velocity gradient VG at the outlet portion 25*a* of the injection hole 25 can be increased effectively while suppressing the variation in the injection angle as of the fuel spray injected from the outlet portion 25*a* of the injection hole 25.

As shown in the relationship between the value Ds/Dp and the velocity gradient VG of FIG. 9A, the velocity gradient VG decreases as the value Ds/Dp is decreased. When the value Ds/Dp is set to smaller than 1.5, the velocity gradient VG significantly decreases, so the velocity gradient VG cannot be increased effectively. The reason has been revealed by the results of the numerical analysis of the flow velocity distribution of the fuel using an example of FIGS. 10A and 10B (Ds/Dp=1.5) and an example of FIGS. 11A and 11B (Ds/Dp=3).

Figure 10A:
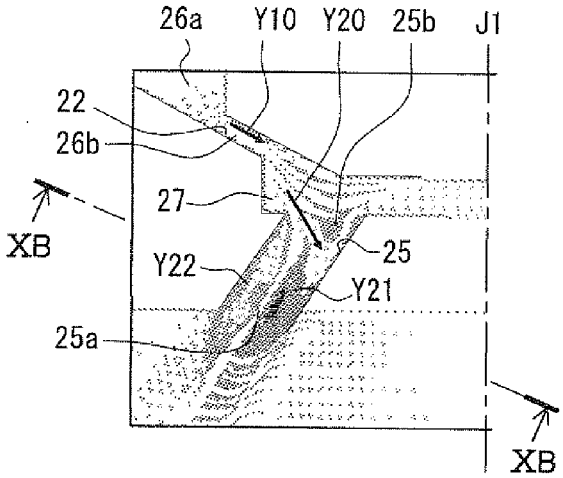
FIG. 10A is a sectional diagram showing a flow velocity distribution of the fuel when Ds/Dp=1.5 according to the first embodiment.
Figure 10B:
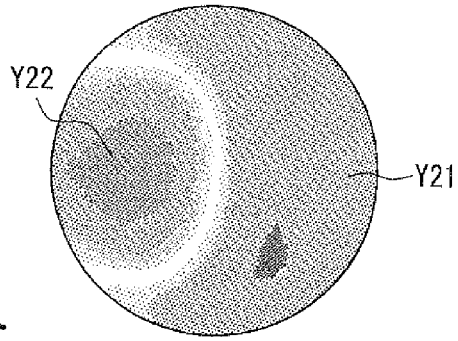
FIG. 10B is a sectional diagram showing the flow velocity distribution of FIG. 10A along an arrow mark XB.
Figure 11A:
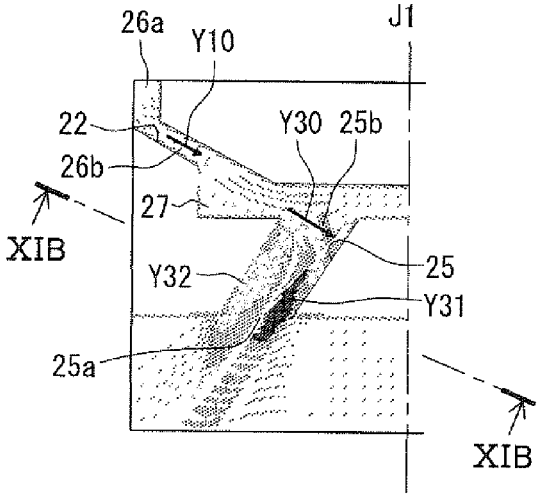
FIG. 11A is a sectional diagram showing another flow velocity distribution of the fuel when Ds/Dp=3 according to the first embodiment.
Figure 11B:
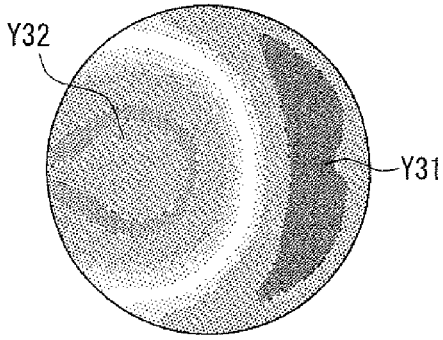
FIG. 11B is a sectional diagram showing the flow velocity distribution of FIG. 11A along an arrow mark XIB.

Each of FIGS. 10A and 11A shows the flow velocity distribution in the fuel chamber 70 and the injection hole 25 on a section including the central axis J2 direction of the injection hole 25. Each of FIGS. 10B and 11B shows the flow velocity distribution on a section perpendicular to the central axis J2 at the outlet portion 25*a*, i.e., a formation state of the velocity gradient VG at the outlet portion 25*a*.

The mainstream direction Y10 of the fuel flowing out to the fuel chamber 70 when the needle 30 lifts is decided mostly by a diameter reducing direction of the inner wall surface 22 (i.e., a direction along the conical shape in the diagram) regardless of the value Ds/Dp. The diameter reducing direction of the inner wall surface 22 is a direction, along which the diameter of the inner wall surface 22 reduces.

The fuel flow in the mainstream direction Y10 changes into a mainstream flow direction Y20 (or Y30) toward the inlet portion 25*b* in accordance with the magnitude of the value Ds/Dp. Thereafter, a difference will arise in general between flow velocity of a fuel flow Y21 (or Y31) on the side near the central axis J1 and flow velocity of a fuel flow Y22 (or Y32) on the side distant from the central axis J1 in a fuel flow in the outlet portion 25*a*, and the velocity gradient arises.

However, in the case where Ds/Dp=1.5 as shown in FIG. 10A, the radial distance between the tip of the inner wall surface 22 downstream of the seat section 33 (i.e., the right end of the inner wall surface 22 in the diagram) and the inlet portion 25*b* of the injection hole 25 is relatively short. Therefore, the fuel flow in the mainstream direction Y20 toward the inlet portion 25*b* does not collide with and is not pressed against the injection hole inner peripheral surface 25*c* on the inlet portion 25*b* side but collides with and is pressed against the injection hole inner peripheral surface 25*c* on the outlet portion 25*a* side. As a result, although the difference occurs in the fuel flow velocity in the flow velocity distribution at the outlet portion 25*a* of FIG. 10B among the different points, the fuel is injected from the outlet portion 25*a* before forming the effectively increased velocity gradient VG.

In the case where Ds/Dp=3 as shown in FIG. 11A, the radial distance between the tip of the inner wall surface 22 and the inlet portion 25*b* of the injection hole 25 is relatively long. Therefore, the fuel flow in the mainstream direction Y30 heading to the injection hole inlet portion 25*b* is pressed against the injection hole inner peripheral surface 25*c* on the inlet portion 25*b* side while the fuel flow in the mainstream direction Y30 to the injection hole inlet portion 25*b* hardly changes the flow direction from the mainstream direction Y10. Therefore, in the case where Ds/Dp=3, i.e., when the value Ds/Dp is set at a large value, the velocity gradient VG at the outlet portion 25*a* can be increased sufficiently by the time when the fuel flow reaches the outlet portion 25*a* as shown in FIGS. 11A and 11B. That is, the effectively increased velocity gradient VG can be formed at the outlet portion 25*a*.

Figure 12A:
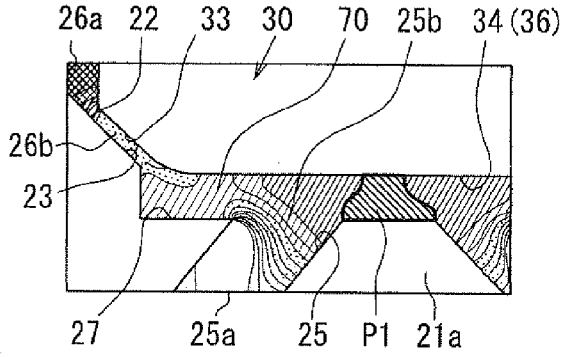
FIG. 12A is a sectional diagram explaining a relationship between the value Ds/Dp and fuel pressure in the fuel chamber when Ds/Dp=3 according to the first embodiment.
Figure 12B:
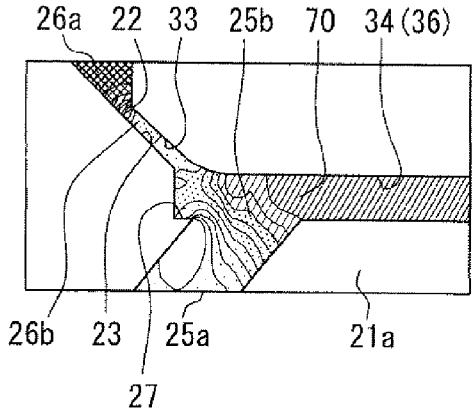
FIG. 12B is a sectional diagram explaining a relationship between the value Ds/Dp and the fuel pressure in the fuel chamber when Ds/Dp=1.5 according to the first embodiment.
Figure 12C:
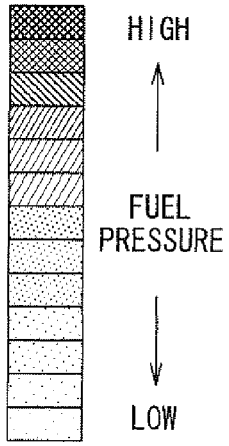
FIG. 12C is a diagram showing the fuel pressure level in the fuel chamber according to the first embodiment.

Following knowledge has been obtained from another result of the numerical analysis in the case of setting the value Ds/Dp to more than 3. Each of FIGS. 12A and 12B shows the result of the numerical analysis of the pressure distribution in the fuel chamber 70 and the injection holes 25. According to the result, it has been found that, in the case where Ds/Dp=3 as shown in FIG. 12A, the fuel pressure at an inside region directly above the plate-like portion 21*a* becomes pressure P1 higher than the pressure in the other portion in the fuel chamber 70.

The existence of the high pressure P1 in the inside region directly above the plate-like portion 21*a* near the inlet portion 25*b* indicates that the pressure in the inlet portion 25*b* suffers interference from the pressure P1. As a result, due to the influence of both pressures interfering with each other, the variation a in the injection angle as of the spray shown in FIG. 9C increases abruptly and turns into a remarkable variation.

When the value Ds/Dp is set smaller than 1.5 as shown in FIG. 12B, the high pressure P1 does not exist in the inside region directly above the plate-like portion 21*a*. However, since the above-mentioned disorder of the fuel flow arises, the variation σ in the injection angle as of the spray shown in FIG. 9C increases abruptly and turns into a remarkable variation also when the value Ds/Dp is set smaller than 1.5.

(Reason and Effect of Setting Range of Index Value t/d)

If the mainstream heading to the injection hole inlet portion 25*b* is pressed against the inner peripheral surface on the inlet portion 25*b* side, the velocity gradient should be increased toward the outlet portion 25*a*. However, after the mainstream is pressed against the injection hole inner peripheral surface 25*c*, the other flows than the mainstream will also be rectified by the injection hole inner peripheral surface 25*c*. Therefore, the inventors think that there is a possibility that the magnitude of the effectively increased velocity gradient VG falls significantly depending on the size of the injection hole length of the injection hole 25.

In view of such the circumstances, the characteristic construction that the index value t/d related to the size of the injection hole length satisfies an inequality: $1.25 \leqq t/d \leqq 3$ is employed. Thus, the significant fall of the effectively increased velocity gradient VG can be avoided. Thus, the atomization can be further promoted with the velocity gradient VG.

Figure 13A:
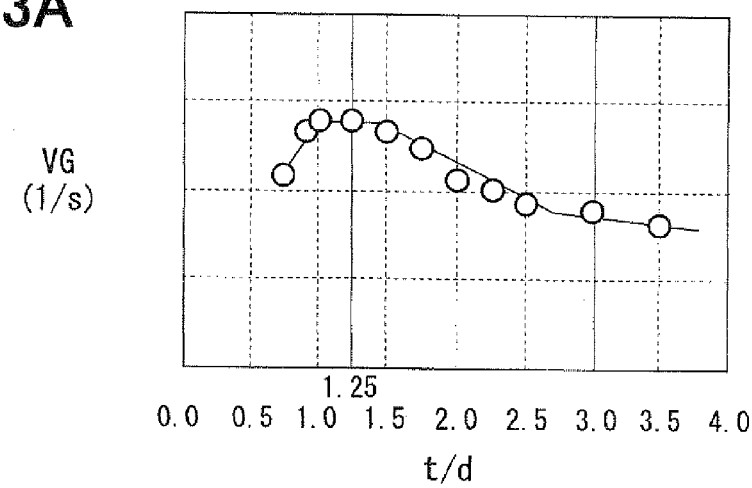
FIG. 13A is a characteristic diagram showing a relationship between a value t/d and the velocity gradient according to the first embodiment.
Figure 13B:
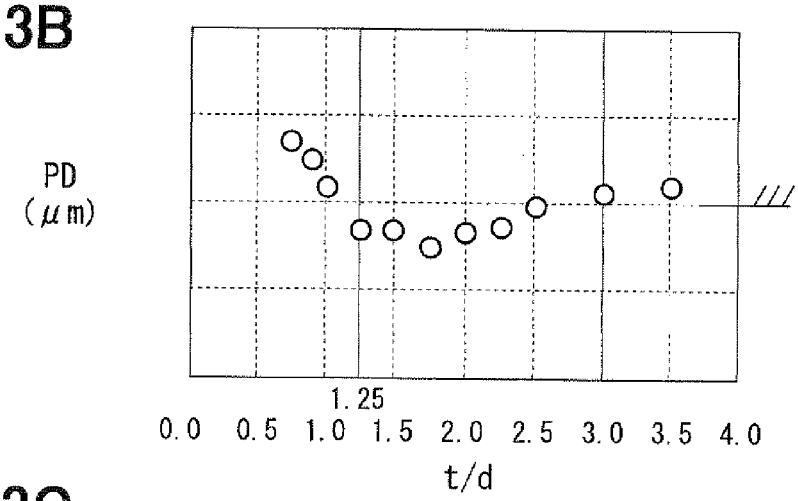
FIG. 13B is a characteristic diagram showing a relationship between the value t/d and the particle diameter according to the first embodiment.
Figure 13C:
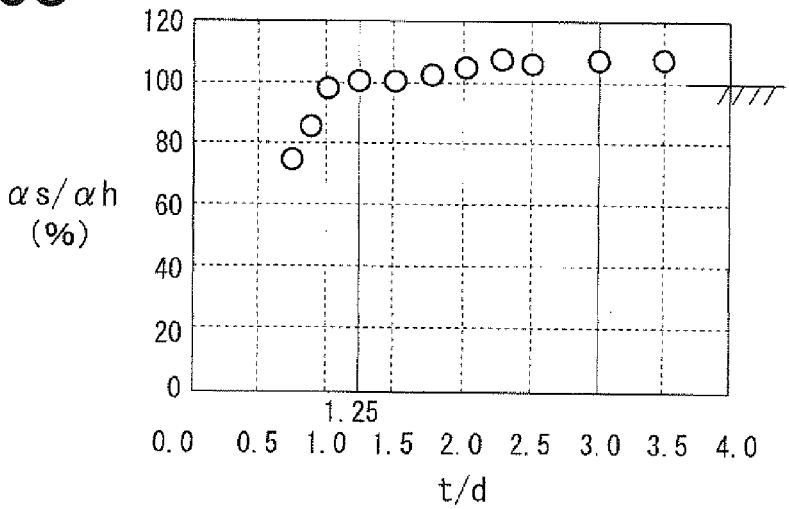
FIG. 13C is a characteristic diagram showing a relationship between a spray contraction ratio and the value t/d according to the first embodiment.

FIGS. 13A to 13C show the test results of measuring the velocity gradient VG, the particle diameter PD and the variation of the injection angle as about a single injector 10 while changing the value t/d as a parameter. FIGS. 13B and 13C focus on the spray that is highly atomized by the velocity gradient VG. FIG. 13B shows the relationship between the value t/d and the particle diameter PD. FIG. 13C shows the relationship between the value t/d and a spray contraction ratio αs/αh related to the spray shape.

As shown in the relationship between the value t/d and the velocity gradient VG of FIG. 13A, there is a tendency that the velocity gradient VG gradually increases as the value t/d is increased. However, if the value t/d exceeds a predetermined value range, the velocity gradient VG falls. In more detail, the velocity gradient VG increases as the value t/d is increased until the value t/d reaches approximately 1. Then, if the value t/d exceeds approximately 1.5, the velocity gradient VG decreases as the value t/d is increased. In furthermore detail, in the range from 1.5 to 3.5 of the value t/d, the reducing degree of the velocity gradient VG with respect to the change in the value t/d is comparatively large until the value t/d reaches approximately 2.5. If the value t/d exceeds 2.5, the reducing degree of the velocity gradient VG with respect to the change of the value t/d significantly decreases and becomes small.

The inventors set the upper limit value 3 and the lower limit value 1.25 of the value t/d for following reasons. That is, the setting is based on the knowledge that the particle diameter PD significantly increases, i.e., the function of promoting the atomization is impaired, when the value t/d is smaller than 1.25 or larger than 3 as shown in the result focusing on the particle diameter PD as shown in FIG. 13B. In other words, it has been found that the limit for effectively increasing the velocity gradient VG is t/d=1.25 and the limit for allowing the reducing degree of the velocity gradient VG accompanying the increase in the value t/d is t/d=3.

From the viewpoint of surely preventing the fuel of the fuel spray, which is injected from the injector 10, from adhering to the wall surfaces 65, 67 of the cylinder inside 64, the inventors consider that the function of the value t/d to control the injection direction, i.e., the spray contraction ratio as/ah, is an important elemental function. That is, if the value t/d exceeds 1.25, the spray contraction ratio as/ah approaches to approximately 100% and the injection direction can be decided by the inclination ah of the injection hole 25 as shown by the result of FIG. 13C focusing on the injection direction controllability. In other words, when the value t/d is smaller than 1.25, the velocity gradient VG can be increased effectively but the injection direction controllability expressed with the index of the spray contraction ratio as/ah falls as shown in FIG. 13C. Such the value t/d=1.25 is employed as the limit for effectively increasing the velocity gradient VG.

The above is the explanation of the characteristic constructions related to the second invention. Next, the characteristic constructions related to the first invention will be explained with reference to FIGS. 2 and 14A to 14E.

(Characteristic Construction of Injector 10 Related to First Invention)

The inner wall surface 22 in the conical shape corresponds to an inner peripheral surface portion defining the valve seat section. Therefore, the diameter reducing direction of the inner wall surface 22 corresponds to the diameter reducing direction of the valve seat section 23 explained in the above description of the second invention.

The first invention has been invented based on the principle for solving the problem explained in the above description of the second invention. Specifically, an object of the first invention is to suppress the reduction of the flow energy before the mainstream of the fuel flows into the inlet portion 25*b* of the injection hole 25 in order to suppress the fall of the injection velocity V accompanying the formation of the velocity gradient VG.

The first invention has been made in view of following circumstances. That is, in the injector of the conventional technology described in Patent document 2 (JP-A-H11-70347) or JP-A-H3-264767, the fuel chamber is formed substantially in the cylindrical shape to facilitate the distribution of the fuel, which flows into the fuel chamber, to the respective injection holes. However, in such the conventional technology, the tip section located to face the inlet portion of the injection hole is formed such that an opposed end face is located directly above the inlet portion. Therefore, there is a concern that, when the mainstream of the fuel flows into the fuel chamber when the seat section separates from the valve seat section, the mainstream does not flow into the inlet portion of the injection hole straight, causing a turning loss.

If the turning loss is caused in the flow of the fuel including the mainstream before the fuel flow flows into the inlet portion 25*b*, the flow energy decreases and the flow velocity of the flow flowing into the inlet portion 25*b* falls. As a result, the injection velocity of the fuel injected from the injection hole 25 falls. This means that another factor reducing the injection velocity is added to the factor reducing the injection velocity due to the formation of the velocity gradient. Therefore, in view of such the circumstances, an object of the first invention is to achieve both of the low penetration force and the high atomization while preventing the excessive decrease in the injection velocity.

Therefore, the characteristic constructions related to the first invention are set as follows. That is, as shown in FIG. 2, the inclined surface 35 is formed at the tip section 34 of the needle 30 as the above-described valve member such that the inclined surface 35 spreads in the annular shape and radially inward from the lower end of a seat surface 33*a* defining the seat section 33. The seat surface 33*a* of the seat section 33 is formed to face the inner wall surface 22. A seat angle β as a crossing angle of the seat surface 33*a* (shown in FIG. 2) is set in the range from 80 to 130 degrees.

The crossing angle of the inner wall surface 22, on which the seat section 33 is seated and from which the seat section 33 separates, is set substantially the same as or slightly smaller than the seat angle β. The inclination ah of the injection hole 25 is set in the range from −10 to 40 degrees. A preferable range of the inclination ah of the injection hole 25 is a range from 0 to 40 degrees.

The nozzle body 21 is structured with a following positional relationship between the inner wall surface 22 and the injection hole 25. That is, on a virtual plane (a sheet surface of FIG. 2) including the central axis J2 of the injection hole 25, the inlet portion 25*b* of the injection hole 25 is located on a virtual extended line ms extending along the diameter reducing direction of the inner wall surface 22. The virtual extended line ms intersects with the injection hole inner peripheral surface 25*c* on the inlet portion 25*b* side. That is, an intersecting point mc of the virtual extended line ms is located on the injection hole inner peripheral surface 25*c*. Thus, the fuel flow in the mainstream direction can be controlled into the flow flowing straight into the inlet portion 25*b*. Therefore, the turning loss of the fuel flow can be suppressed even after the mainstream of the fuel passes the inner wall surface 22 when the needle 30 is separate from the inner wall surface 22. Thus, the fuel can be caused to flow into the inlet portion 25*b* while suppressing the reduction of the flow energy of the fuel.

The needle 30 is structured with a positional relationship between the inclined surface 35 of the tip section 34 and the injection hole 25 described below. That is, the inclined surface 35 spreads inward further than the position where the central axis J2 of the injection hole 25 intersects with the tip section 34. In more detail, the tip of the inclined surface 35 is located radially inside the position where the central axis J2 of the injection hole 25 intersects with the tip section 34. Thus, the mainstream of the fuel is rectified along the inclined surface 35 even after the mainstream of the fuel passes the seat surface 33*a* when the seat surface 33*a* separates from the inner wall surface 22, so the turning loss of the fuel flow is inhibited.

With the construction of the nozzle body 21 and the needle 30 described above, the mainstream direction of the fuel can be surely controlled into the direction of the flow flowing straight into the inlet portion 25*b* of the injection hole 25 with the seat section 33 and the valve seat section 23, i.e., with the seat surface 33*a*, the inclined surface 35 and the inner wall surface 22. Thus, the mainstream of the fuel can be caused to flow into the inlet portion 25*b* while inhibiting the reduction of the flow energy.

Moreover, the mainstream of the fuel collides with the injection hole inner peripheral surface 25*c* when the mainstream flows into the inlet portion 25*b*. Therefore, a disorder can be caused in the fuel while the mainstream moves from the inlet portion 25*b* side to the outlet portion 25*a* side along the injection hole inner peripheral surface 25*c*, with which the mainstream has collided. As a result, the large velocity gradient VG can be formed at the outlet portion 25*a*.

The test and the numerical analysis performed by the inventors has revealed that the inflow to the inlet portion 25*b* of the injection hole 25 can be facilitated when an angle θ between the seat surface 33*a* and the inclined surface 35 satisfies an inequality: 18 degrees≦θ≦27 degrees. In other words, a fuel passage portion at the seat surface 33*a* and the inclined surface 35 out of the fuel passages 26 shown in FIG. 2 is set in the passage shape facilitating the inflow to the inlet portion 25*b*.

As shown in FIG. 2, the angle θ is an angle, by which the inclined surface 35 inclines from the seat surface 33*a* in a direction separating from the inner wall surface 22.

FIGS. 14A to 14E show test results of measuring the velocity gradient VG, the injection velocity V and a flow rate coefficient about a single injector 10 while changing the value of the angle θ as a parameter. The conditions of the test and the numerical analysis include a condition: the fuel injection pressure=10 MPa. Solid lines in FIGS. 14A to 14E show the data obtained by the numerical analysis.

Figure 14A:
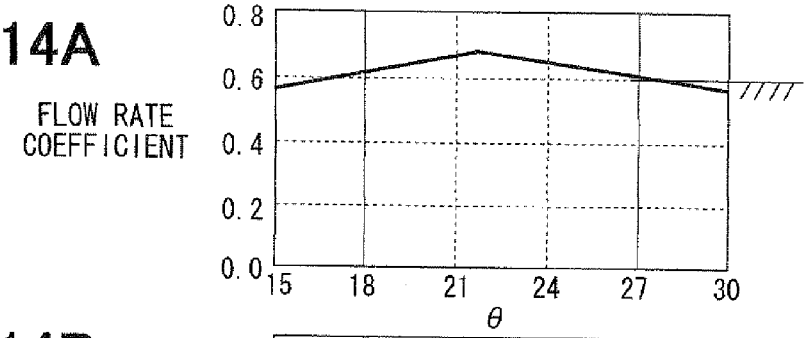
FIGS. 14A to 14E are characteristic diagrams explaining relationships among an angle between a seat surface and an inclined surface at a tip section of a valve member, a flow rate coefficient, the velocity gradient and the injection velocity according to the first embodiment.
Figure 14B:
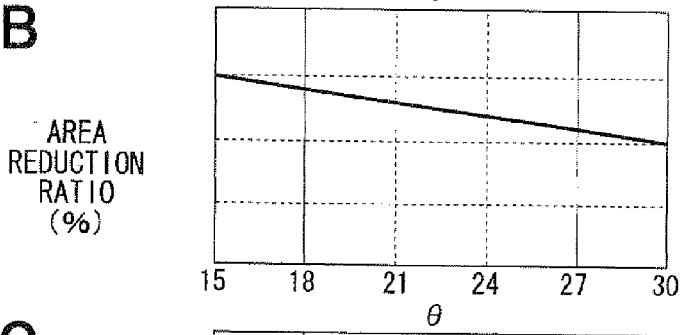
Figure 14C:
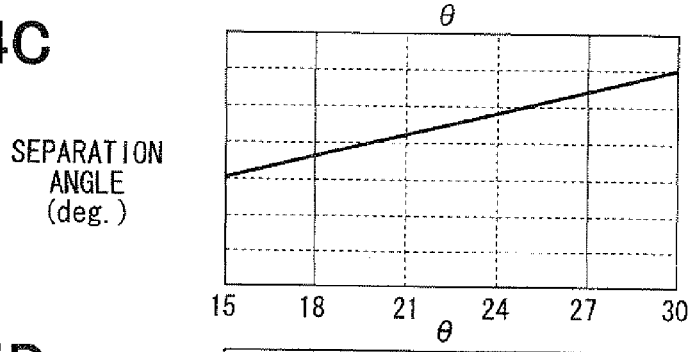

As shown in the relationship between the flow rate coefficient and the angle θ of FIG. 14A, there is a tendency that the flow rate coefficient increases gradually as the angle θ is increased. It is because a reduction ratio of the sectional area in the fuel passage portion at the above-described seat surface 33*a* and the inclined surface 35 of FIG. 14B is suppressed to a small value by the increase in the angle θ. However, if the angle θ exceeds a predetermined value range, as shown by an index referred to as a separation angle of FIG. 14C, a degree of separation of the fuel flow portion near the inclined surface 35 from the inclined surface 35 increases excessively among the fuel flows including the mainstream. Therefore, the flow rate coefficient decreases as the angle θ increases in this case.

The inventors set the upper limit value 27 and the lower limit value 18 of the above-described angle θ because the flow rate coefficient equal to or greater than a predetermined value (0.6 in the present embodiment), which indicates a passage shape comparatively facilitating the fuel flow, can be secured by setting the angle θ in the range: 18 degrees≦θ≦27 degrees as shown in the characteristic diagram of the flow rate coefficient of FIG. 14A.

Figure 14D:
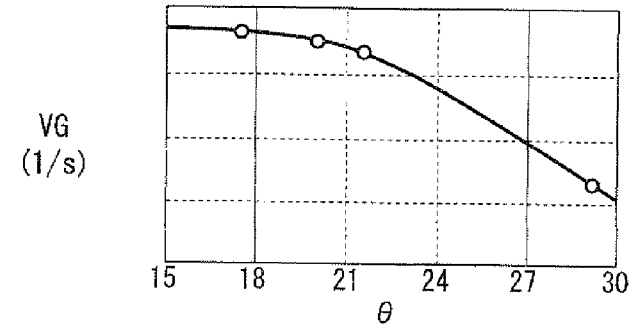
Figure 14E:
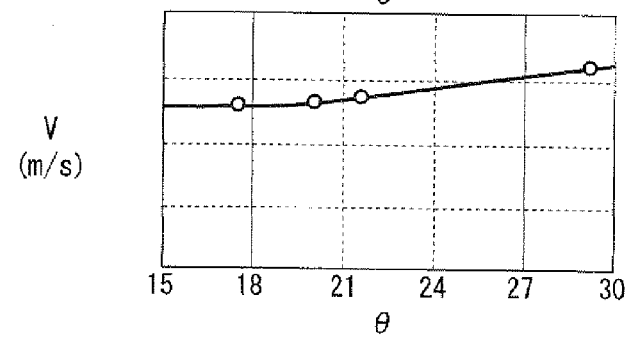

FIG. 14D shows a relationship between the angle θ and the velocity gradient VG. There is a tendency that the velocity gradient VG decreases as the angle θ increases. The inventors consider that it is because the pressing degree of pressing the mainstream against the injection hole inner peripheral surface 25*c* changes due to the excessive generation of the separation although the predetermined flow rate coefficient can be obtained more easily since the area of the fuel passage portion at the seat face 33*a* and the inclined surface 35 increases with the increase of the angle θ. Based on the knowledge about such the results of FIGS. 14A to 14E, it has been found that the limit for allowing the fall of the injection velocity V is θ=18 degrees and the limit for allowing the fall of the velocity gradient VG is θ=27 degrees.

According to the present embodiment described above, the promotion of the atomization can be achieved by the combination of the velocity gradient formation at the outlet portion 25*a* and the injection velocity unlike the conventional technology, which achieves the promotion of the atomization by the high penetration force, i.e., by increasing the injection velocity. Therefore, both of the low penetration force and the high atomization can be achieved. Moreover, as measures against the reduction in the injection velocity accompanying the formation of the velocity gradient, the fuel is caused to flow into the inlet portion 25*b* of the injection hole 25 while suppressing the reduction of the flow energy. Accordingly, both of the low penetration force and the high atomization can be achieved at the same time while preventing the excessive fall of the injection velocity.

In the present embodiment, the tip of the inclined surface 35 in the tip section 34 should be preferably located radially inside the position of the inlet portion 25*b*. Thus, the turning loss of the fuel flow can be inhibited until the mainstream of the fuel arrives at the position of the inlet portion 25*b* even after the mainstream of the fuel passes the seat section 33.

Second Embodiment

Figure 15:
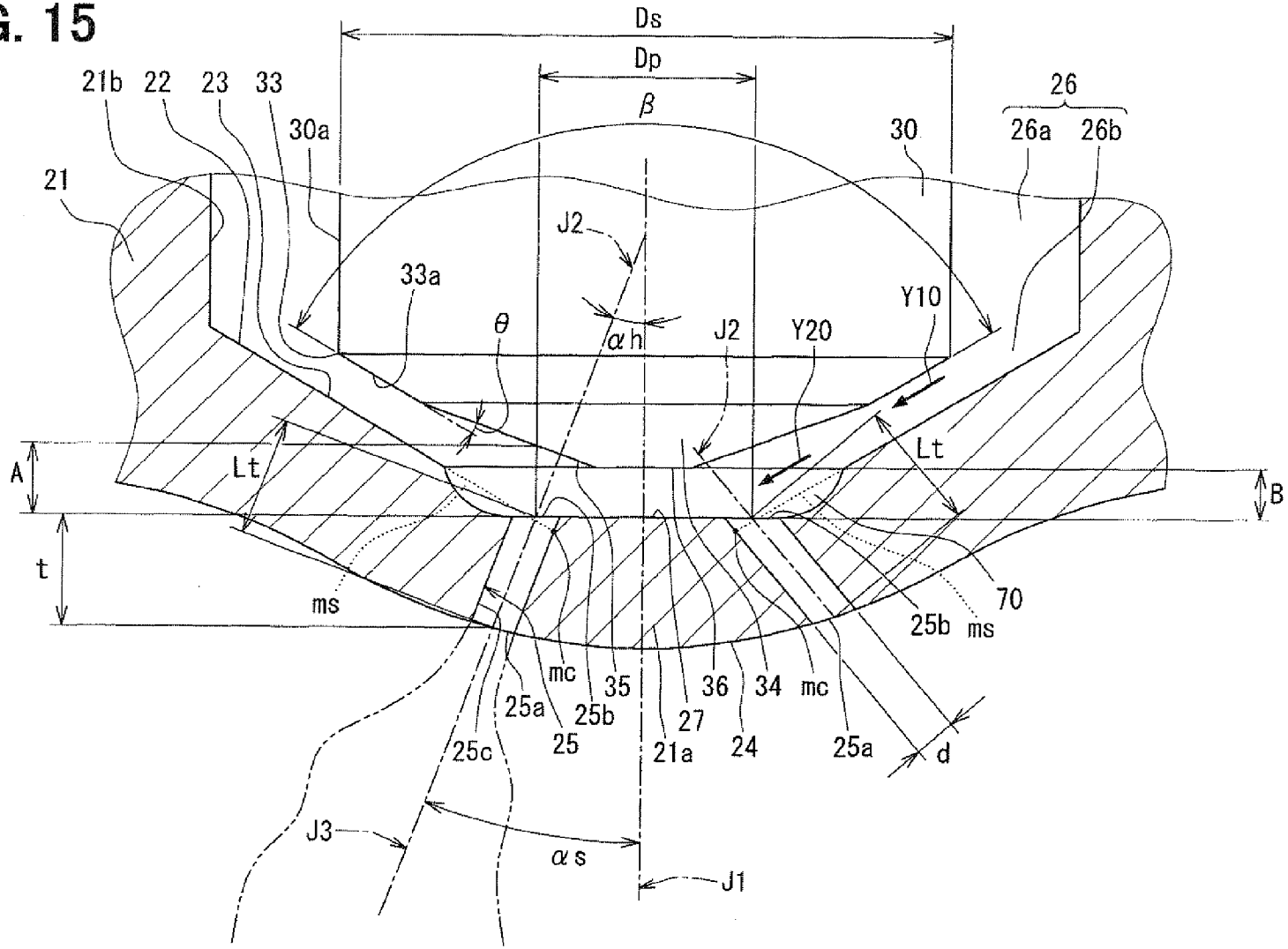
FIG. 15 is a sectional diagram showing a vicinity of injection holes and a fuel chamber of an injector according to a second embodiment of the present invention.

FIG. 15 shows a second embodiment of the present invention. The second embodiment is a modification of the first embodiment. FIG. 15 shows a part of the injector and specifically a vicinity of the injection holes and the fuel chamber upstream of the injection holes with respect to a fuel flow direction.

The needle 30 is structured with a positional relationship between the inclined surface 35 of the tip section 34 and the injection holes 25 described below. That is, the tip of the inclined surface 35 spreads radially inside more than the position of the inlet portion 25*b*. The fuel passage portion at the seat surface 33*a* and the inclined surface 35 constructed in such a manner has a function to suppress the turning loss of the fuel flow at least until the mainstream of the fuel reaches radially inside the position of the inlet portion 25*b* even after the mainstream of the fuel passes the seat section 33. Thus, the fuel can be caused to flow into the inlet portion 25*b* of the injection hole 25 while maintaining the flow energy without decreasing the flow energy.

The injection angle as of the fuel spray is decided by required performance of the engine mounted with the injector 10 and the like. Therefore, there is a concern that the respective injection holes 25 formed in the recess portion 27 are set at different injection angles αs. Since the injection hole length changes with the aimed injection angle αs, the degree of the atomization will vary among the injection holes 25 with the different injection angles αs.

In this regard, in the present embodiment, the construction of the plate-like portion 21*a*, in which the injection holes 25 are formed, is provided as follows in the recess portion 27 of the nozzle body 21. That is, the surface of the plate-like portion 21*a* on the inlet portion 25*b* side is formed as a flat surface and the surface of the plate-like portion 21*a* on the outlet portion 25*a* side is formed as a spherical surface.

The surface on the outlet portion 25*a* side is formed such that spherical surfaces formed among the outlet portions 25*a* of the respective injection holes 25 are connected with each other continuously and are formed in a convex spherical shape protruding downstream with respect to the fuel flow direction (i.e., downward in FIG. 15) as a whole.

In the above construction, the surface on the inlet portion 25*b* side is formed as the flat surface and the surface on the outlet portion 25*a* side is formed as the spherical surface in the plate-like portion 21*a*. Therefore, the difference in the injection hole length due to the difference among the injection angles as of the respective injection holes 25 can be inhibited. Thus, the variation in the atomization among the injection holes 25 having the different injection angles as can be inhibited.

Figure 16:
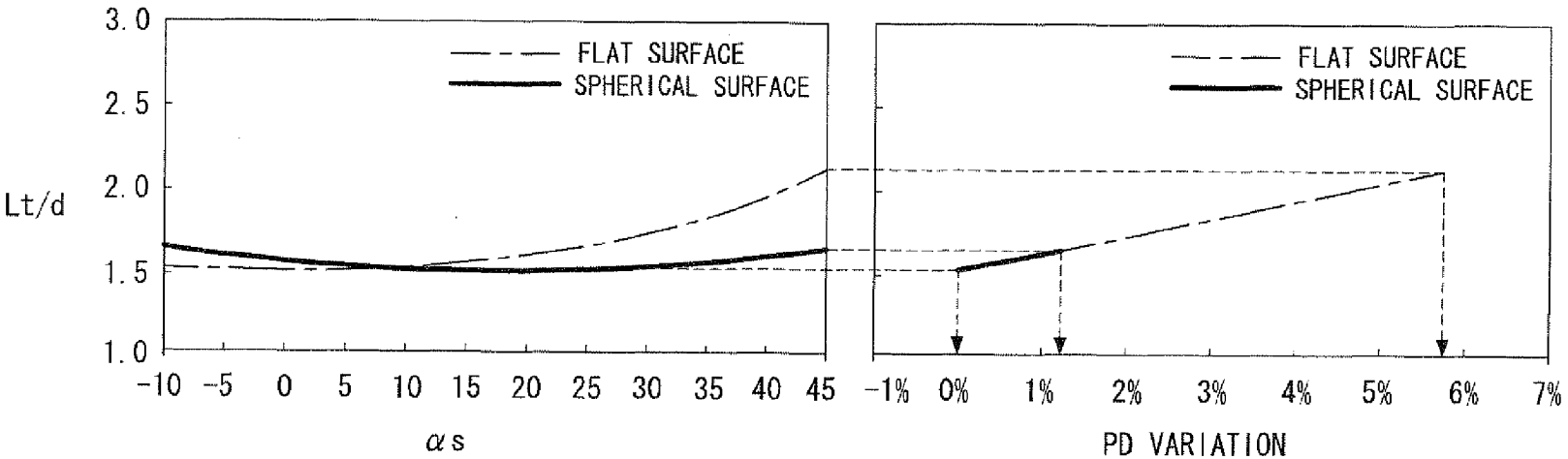
FIG. 16 is a characteristic diagram showing a relationship among a value Lt/d, an injection angle and a degree of change in a particle diameter according to the second embodiment.

A left graph of FIG. 16 shows a relationship between an index value Lt/d and the injection angle αs. A right graph of FIG. 16 shows a relationship between the index value Lt/d and a variation degree (change degree) of the particle diameter PD. The index value Lt/d is related to the injection hole length Lt and is a ratio of the injection hole length Lt to the diameter d of the injection hole 25. The variation in the particle diameter PD of the right graph of FIG. 16 shows a degree of change in the particle diameter PD on the basis of the particle diameter PD at the time when Lt/d=1.5.

The injection angle αs, i.e., the inclination αh of the injection holes 25 substantially the same αs the injection angle as, is set in the range: −10 degrees≦αh≦45 degrees. In the setting range, when both sides of the plate-like portion 21*a* are flat surfaces, the value Lt/d changes approximately in the range from 1.5 to 2.1. As a result, the particle diameter PD causes a variation of approximately 0 to 5.7% as shown in FIG. 16.

In contrast, in the present embodiment, the value Lt/d can be limited in the range approximately from 1.5 to 1.6. As a result, the variation in the particle diameter PD can be effectively limited approximately in the range from 0 to 1.2%.

Other Embodiments

The present invention is not limited to the above embodiments but can be applied to various embodiments as long as not deviating from the gist thereof.

Figure 17A:
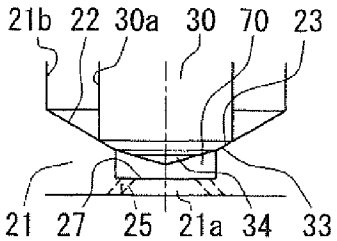
FIGS. 17A to 17L are sectional views each showing a vicinity of injection holes and a fuel chamber according to each of other embodiments of the present invention.
Figure 17B:
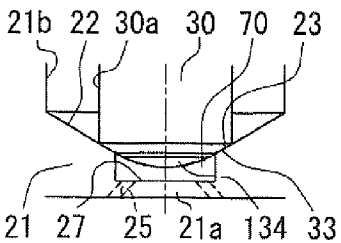
Figure 17C:
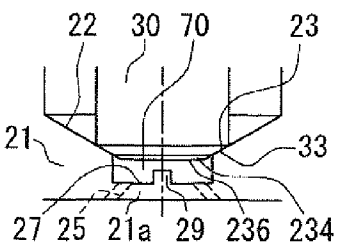
Figure 17D:
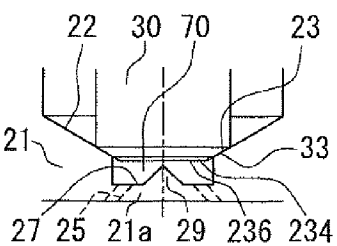
Figure 17E:
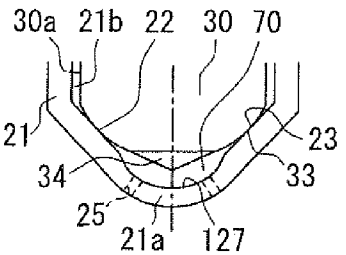
Figure 17F:
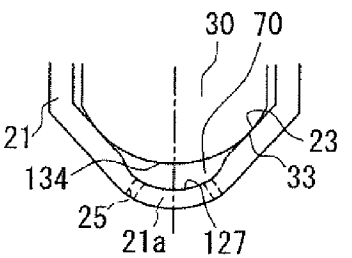
Figure 17G:
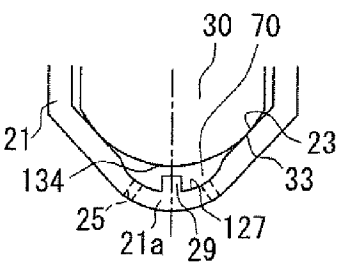
Figure 17H:
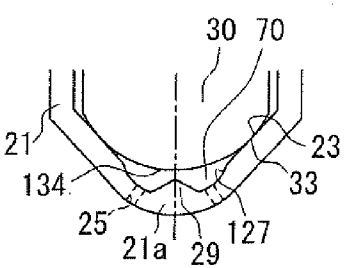
Figure 17I:
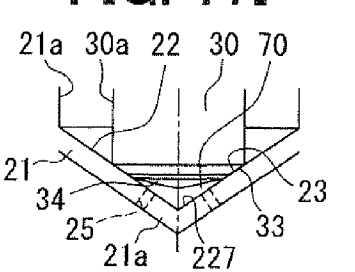
Figure 17J:
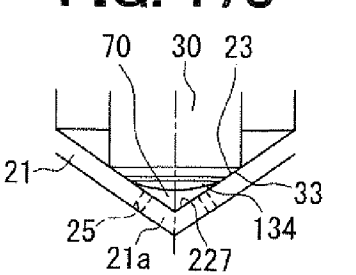

(1) In the above-described embodiments, the fuel chamber 70 related to the second invention is formed in the shape connecting the valve seat section 23 with the inner peripheral side of the bottom portion of the recess portion 27 through the smooth curved surface. Alternatively, the fuel chamber 70 may be formed in various shapes described in following modified examples of FIGS. 17A to 17L. That is, a cylindrical recess, which is defined by an inner peripheral surface perpendicular to the bottom portion instead of the above-described curved surface, may be employed as shown in FIG. 17A. Alternatively, as shown in another modified example of FIG. 17E, the bottom portion of the recess portion may be formed in the same shape of a curved surface as the above-described curved surface. Alternatively, as shown in another modified example of FIG. 17I, the recess portion may be formed in a conical shape and the bottom portion and the valve seat section 23 may be defined by an inner peripheral surface of the conical shape.

The bottom portion of the recess portion 27 of each of the modified examples of FIGS. 17A to 17D is provided by the plate-like portion 21*a* as in the above-described first embodiment. A recess portion 127 of each of the modified examples of FIGS. 17E to 17H including the bottom portion is formed in a hemispherical surface shape. A recess portion 227 of each of the modified examples of FIGS. 17I to 17L including the bottom portion is formed in a conical surface shape. The bottom portion corresponds to the plate-like portion 21*a* of the above-described embodiments.

(2) In each of the above-described embodiments, the tip section 34 of the needle 30 is formed substantially in the conical shape. Alternatively, a tip section 134 may be formed substantially in the spherical surface shape as shown in the modified example of FIG. 17B. Alternatively, the tip section 134 may be formed substantially in the shape of a spherical surface such that the tip section 134 faces the recess portion 127 in the shape of the above-described hemispherical surface as shown in the modified example of FIG. 17F. Alternatively, the tip section 134 may be formed substantially in the spherical surface shape such that the tip section 134 faces the recess portion 227 in the shape of the above-described conical surface as shown in the modified example of FIG. 17J.

Figure 17K:
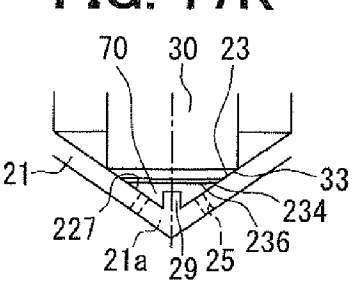
Figure 17L:
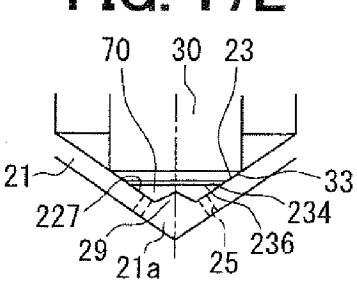

(3) In the above-described embodiments, the tip section is formed in the conical shape to satisfy the inequality: B<A, wherein the values A/Ds and B/Ds are the index values defining the shape of the fuel chamber 70. The present invention is not limited to this. That is, in the modified example of FIG. 17C, a tip section 234 is formed in a flat cylindrical shape, and a stepped portion 29 is formed on the plate-like portion 21*a* on the recess portion 27 side facing an opposed end face 236 of the tip section 234 such that the stepped portion 29 extends toward the opposed end face 236. In the modified example of FIG. 17G, the stepped portion 29 extending toward the tip section 134 is formed in the recess portion 127 in the shape of the hemispherical surface shown in FIG. 17F. In the modified example of FIG. 17K, the stepped portion 29 extending toward the tip section 234 is formed in the recess portion 227 in the conical shape shown in FIG. 17J. The tip section may be formed in the spherical surface shape or the conical shape. Alternatively, the tip section may be formed as the tip section 234 formed in the shape of a flat cylinder as shown in FIG. 17K.

The above-described stepped portion 29 is formed in the cylindrical shape and is provided in the recess portion 27, 127 or 227 to face the tip section.

(4) The stepped portion 29 is not limited to the cylindrical shape. For example, as shown in the modified examples of FIGS. 17D, 17H and 17L, the stepped portion 29 may be formed in the conical shape and the top of the conical stepped portion 29 may be arranged to face the tip section.

Figure 18:
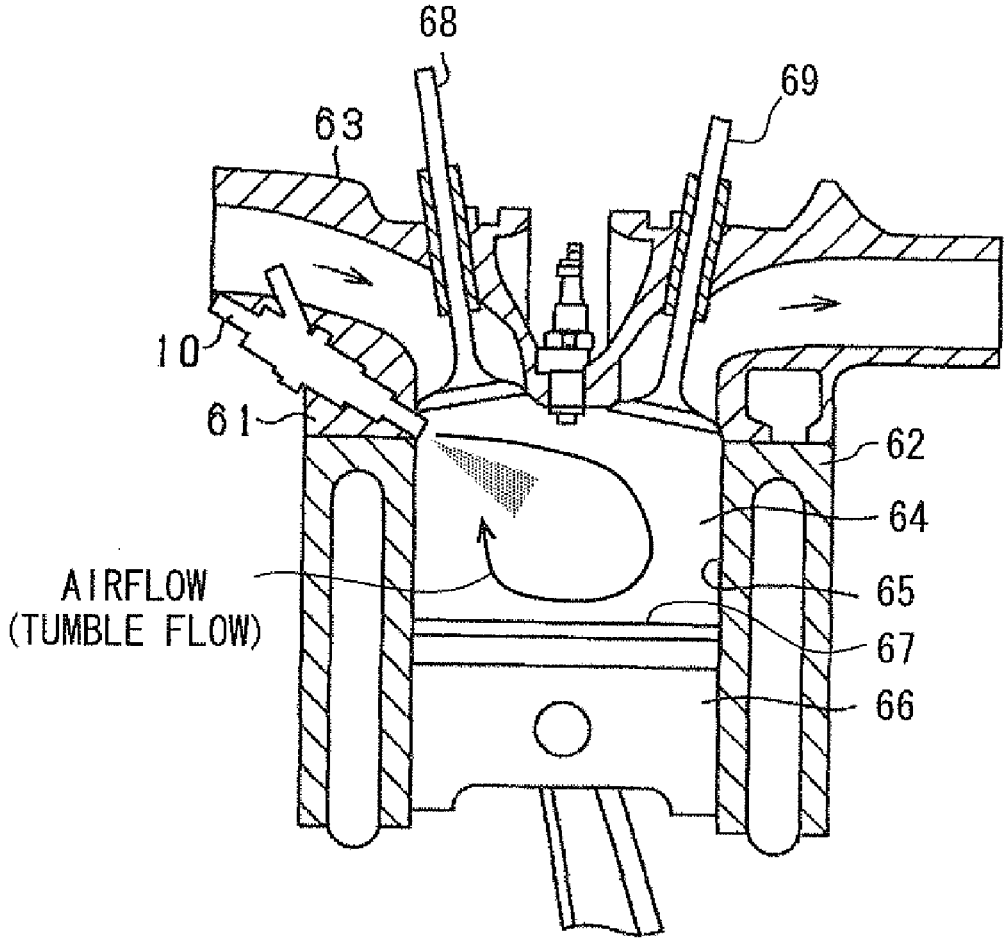
FIG. 18 is a sectional view explaining a relationship between an injector and a combustion chamber of an engine according to another embodiment of the present invention.

(5) In the above-described embodiments, the center mounting of the injector 10 to the cylinder inside 64 is performed, and the spray shape of the fuel injected from the injector 10 is formed in the conical shape. The present invention is not limited to this. Alternatively, for example, as shown in a fuel injection device of a modified example of FIG. 18, slant mounting of the injector 10 to the cylinder inside 64 may be performed and the spray shape of the fuel injected from the injector 10 may be formed in a flat fan shape. In this case, the injector 10 is fixed to a corner of the cylinder inside 64 on an intake valve 68 side in the cylinder head 61. The injector 10 is arranged to be slanted by a predetermined angle from the vertical state toward an exhaust valve 69 side.

(6) In the above-described embodiments, the four injection holes 25 are arranged along the single ring shape on the virtual circle K. The present invention is not limited to this. Alternatively, for example, the number of the injection holes 25 may be two, six, eight or an arbitrary number. When the number of the injection holes 25 is two, the pitch between the injection holes 25 may be defined as Dp instead of defining the diameter of the virtual circle K (pitch diameter) as Dp.

(7) In the case where the shape of the spray from the injector 10 is formed in the flat fan shape, the number of the spray in the flat fan shape is not limited to one. Alternatively, multiple sprays in the flat fan shapes may be formed by the injection from the injector 10.

(8) In the above-described embodiments, the direction of the central axis J2 of the injection hole 25 is inclined such that the outlet portion 25*a* of the injection hole 25 is farther from the central axis J1 of the nozzle body 21 than the inlet portion 25*b* is. With such the construction, when the needle 30 lifts and the mainstream of the fuel flows into the inlet portion 25*b* of the injection hole 25, the mainstream can be effectively pressed against the inner peripheral surface portion on the side near the central axis J1 of the nozzle body 21 in the inner peripheral surface on the inlet portion 25*b* side of the injection hole 25. Therefore, the effectively increased velocity gradient can be formed between the inner peripheral surface portion on the side near the central axis J1 and the inner peripheral surface portion on the side far from the central axis J1 at the outlet portion 25*a*.

(9) In the above description of the embodiments, the characteristic constructions of the conditions (1) to (4) are explained as the essential constructions of the injector 10 according to the embodiments. However, there is no need to satisfy the conditions (1) to (4) at the same time. That is, the injector satisfying at least the conditions (1) and (2) may be employed.

(10) In the above-described embodiments, the cross-sectional shape of the injection hole 25 is formed in the shape of the complete round. Alternatively, the cross-sectional shape may be formed in the shape of an ellipse or a slit.

(11) In the above-described embodiments, the construction forming the recess portion 27 and the injection holes 25 in the nozzle body 21 as the valve body is employed. Alternatively, a plate member as an injection hole formation member may be provided as a body separate from the nozzle body, and the injection holes may be formed in the plate member. In this case, the plate member is formed with the same thickness as the thickness t of the plate-like portion 21*a* corresponding to the bottom portion of the recess portion, for example.

(12) In the above-described embodiments, in the construction related to the first invention, the value of the inclination ah of the injection hole 25 is set in the range: −10 degrees≦αh≦45 degrees. In this case, by setting the value αh not in the range: 0 degrees≦αh≦45 degrees but in the range: −10 degrees≦αh≦45 degrees, the degree of freedom of setting the spray shape can be improved and the adhesion of the fuel to the ignition plug other than the wall surfaces 65, 67 can be inhibited.

Figure 19:
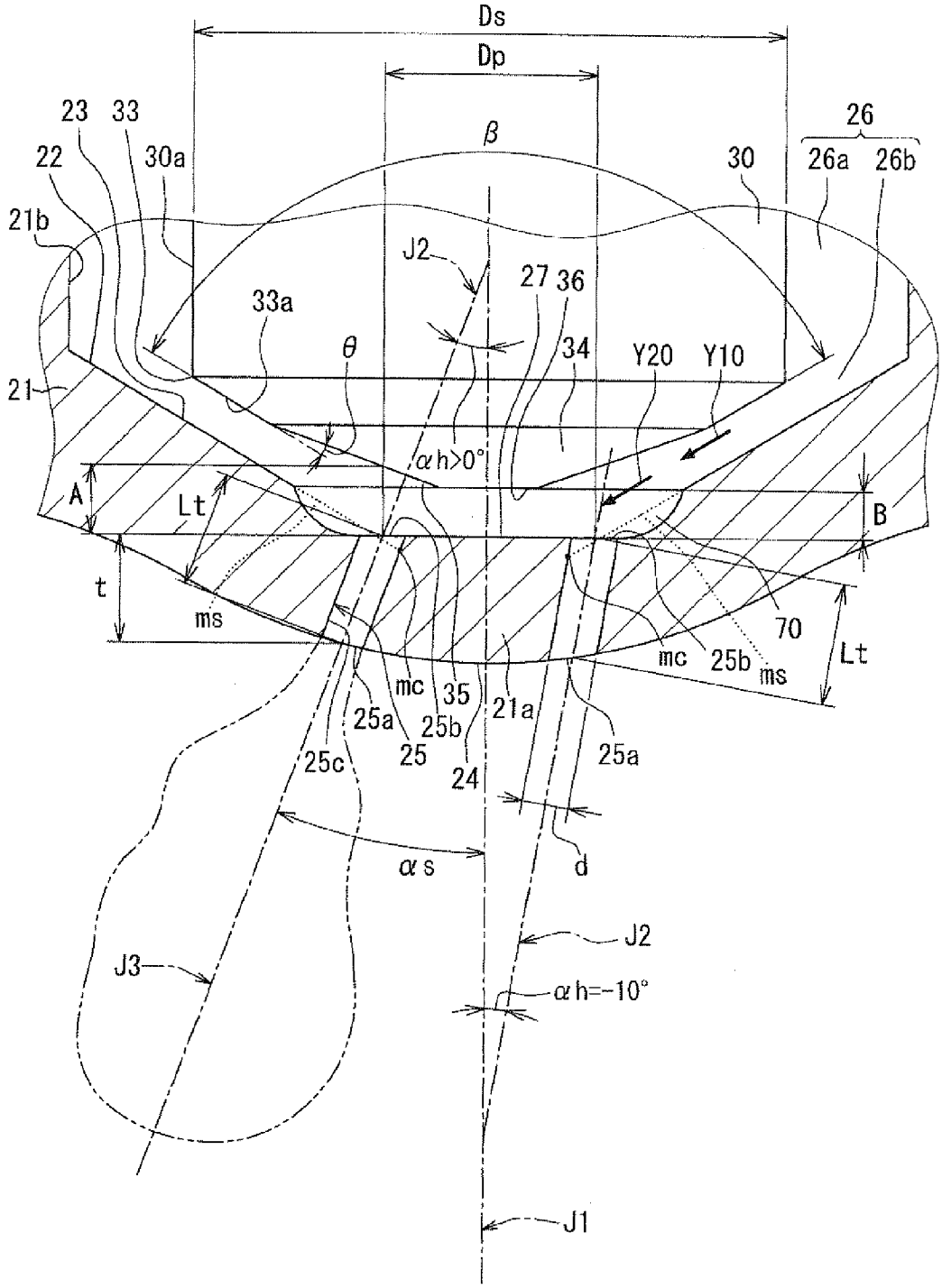
FIG. 19 is a sectional view showing a vicinity of injection holes and a fuel chamber according to yet another embodiment of the present invention.

That is, as shown in FIG. 19, the value of the inclination ah of the injection hole 25 in an injection mainstream direction J3 of the injection of the fuel toward the ignition plug side can be set at a value largely different from the inclination ah of the other injection hole 25 among the injection holes 25 formed in the recess portion 27.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An injector comprising:

a valve body having an inner peripheral surface, which defines a fuel passage and which has a diameter reducing downstream with respect to a fuel flow direction, a valve seat section formed on the inner peripheral surface, a recess portion provided downstream of the valve seat section with respect to the fuel flow direction and an injection hole formed in the recess portion;

a valve member that is arranged in the valve body such that the valve member can reciprocate in an axial direction and that has an outer peripheral surface defining the fuel passage with the inner peripheral surface of the valve body, the valve member having a seat section formed on the outer peripheral surface such that the seat section can be seated on the valve seat section and can separate from the valve seat section and a tip section arranged downstream of the seat section with respect to the fuel flow direction to face the recess portion, wherein the injector injects the fuel, which flows into a fuel chamber defined by the recess portion and the tip section, through the injection hole when the seat section separates from the valve seat section, the valve body is structured such that a virtual extended line extending from an inner peripheral surface portion of the inner peripheral surface, which provides the valve seat section, in a diameter reducing direction of the inner peripheral surface portion, along which a diameter of the inner peripheral surface portion reduces, exists at an inlet portion of the injection hole and intersects with an injection hole inner peripheral surface of the injection hole on a virtual plane including a central axis of the injection hole, and the tip section of the valve member has an inclined surface spreading inward in an annular shape from a downstream end of the seat section, the inclined surface spreading radially inward further than a position where the central axis of the injection hole intersects with the tip section.

2. The injector as in claim 1, wherein the inclined surface of the tip section spreads radially inward further than a position of the inlet portion of the injection hole.

3. The injector as in claim 1, wherein the inclined surface of the tip section is formed in the shape of a truncated cone.

4. The injector as in claim 1, wherein the seat section has a seat surface arranged to face the inner peripheral surface portion of the valve seat section, the inclined surface is provided downstream of the seat section to be inclined in a direction separating from the inner peripheral surface portion, and an angle θ defined between the seat surface and the inclined surface satisfies an inequality: 18 degrees≦θ≦27 degrees.

5. The injector as in claim 1, wherein the fuel chamber is structured such that a seat diameter Ds of the seat section seated on the valve seat section, an axial distance A between the inlet portion of the injection hole and the tip section facing the inlet portion and an axial distance B between an inside region in the recess portion radially inside the inlet portion of the injection hole and the tip section facing the inside region satisfy inequalities: 0.048≦A/Ds≦0.18; B/Ds≦0.18; and B<A.

6. The injector as in claim 5, wherein a stepped portion extending in an axial direction toward the tip section is formed at the inside region of the recess portion.

7. The injector as in claim 1, wherein a plurality of injection holes are formed in the recess portion such that inlet portions of the injection holes are arranged along a single ring shape, and a seat diameter Ds of the seat section seated on the valve seat section and a pitch Dp between the inlet portions of the injection holes satisfy an inequality: 1.5≦Ds/Dp≦3.

8. The injector as in claim 1, wherein a plurality of injection holes are formed in the recess portion such that inlet portions of the injection holes are arranged on a virtual circle, the center of which coincides with a central axis of the valve body, and a seat diameter Ds of the seat section seated on the valve seat section and a diameter Dp of the virtual circle satisfy an inequality: 1.5≦Ds/Dp≦3.

9. The injector as in claim 1, wherein thickness t of a portion of the recess portion where the injection holes are formed and a diameter d of the injection hole satisfy an inequality: 1.25≦t/d≦3.

10. The injector as in claim 1, wherein the central axis of the injection hole is inclined such that an outlet portion of the injection hole is farther from a central axis of the valve body than the inlet portion of the injection hole is.

11. The injector as in claim 1, wherein the inlet portion of the injection hole has a corner, at which the injection hole inner peripheral surface of the injection hole intersects with a recess inner peripheral surface portion of the inner peripheral surface formed in the recess portion, and a corner portion in the corner on a side near the valve seat section has a curved surface that smoothly connects the recess inner peripheral surface portion and the injection hole inner peripheral surface.

12. The injector as in claim 1, wherein a portion of the recess portion where the injection holes are formed has a flat surface as an end face on the injection hole inlet portion side and a spherical surface as the other end face on the injection hole outlet portion side.

13. An injector comprising:

a valve body having an inner peripheral surface, which defines a fuel passage and which has a diameter reducing downstream with respect to a fuel flow direction, a valve seat section formed on the inner peripheral surface, a recess portion provided downstream of the valve seat section with respect to the fuel flow direction and a plurality of injection holes formed in the recess portion;

a valve member that is arranged in the valve body such that the valve member can reciprocate in an axial direction and that has an outer peripheral surface defining the fuel passage with the inner peripheral surface of the valve body, the valve member having a seat section formed on the outer peripheral surface such that the seat section can be seated on the valve seat section and can separate from the valve seat section and a tip section arranged downstream of the seat section with respect to the fuel flow direction to face the recess portion, wherein the recess portion and the tip section provide a fuel chamber substantially in a cylindrical shape, the injector injects the fuel, which flows into the fuel chamber when the seat section separates from the valve seat section, through the injection holes, and a seat diameter Ds of the seat section seated on the valve seat section, an axial distance A between an inlet portion of each of the injection holes and the tip section facing the inlet portion in the fuel chamber and an axial distance B between an inside region of the recess portion located radially inside the inlet portion of the injection hole in the fuel chamber and the tip section facing the inside region satisfy inequalities: $0.048 \leqq A/Ds \leqq 0.18$; $B/Ds \leqq 0.18$; $B<A$.

14. The injector as in claim 13, wherein the tip section of the valve member is formed in the shape of an inclined surface or a spherical surface spreading inward in an annular shape from a downstream end of the seat section.

15. The injector as in claim 13, wherein a stepped portion extending in the axial direction toward the tip section is formed at the inside region of the recess portion.

16. The injector as in claim 13, wherein the inlet portions of the injection holes are arranged along a single ring shape, and a pitch Dp between the inlet portions of the injection holes satisfies an inequality: $1.5 \leqq Ds/Dp \leqq 3$.

17. The injector as in claim 13, wherein the inlet portions of the injection holes are arranged on a virtual circle, the center of which coincides with a central axis of the valve body, and a diameter Dp of the virtual circle satisfies an inequality: $1.5 \leqq Ds/Dp \leqq 3$.

18. The injector as in claim 13, wherein thickness t of a portion of the recess portion where the injection holes are formed and a diameter d of the injection hole satisfy an inequality: $1.25 \leqq t/d \leqq 3$.

19. The injector as in claim 13, wherein an axial direction of the injection hole is inclined such that an outlet portion of the injection hole is positioned farther from a central axis of the valve body than the inlet portion of the injection hole is.

20. The injector as in claim 13, wherein the inlet portion of the injection hole has a corner, at which an injection hole inner peripheral surface of the injection hole intersects with a recess inner peripheral surface portion of the inner peripheral surface formed in the recess portion, and a corner portion in the corner on a side near the valve seat section has a curved surface that smoothly connects the recess inner peripheral surface portion and the injection hole inner peripheral surface.

21. The injector as in claim 13, wherein a portion of the recess portion where the injection holes are formed has a flat surface as an end face on the injection hole inlet portion side and a spherical surface as the other end face on the injection hole outlet portion side.

* * * * *